US009409405B2

(12) United States Patent
Nagase et al.

(10) Patent No.: US 9,409,405 B2
(45) Date of Patent: Aug. 9, 2016

(54) METHOD OF CONTROLLING LIQUID EJECTING APPARATUS AND LIQUID EJECTING APPARATUS

(71) Applicant: SCREEN Holdings Co., Ltd., Kyoto-shi, Kyoto (JP)

(72) Inventors: Yuichi Nagase, Kyoto (JP); Tamio Fukui, Kyoto (JP); Muneaki Kitaoji, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 14/750,760

(22) Filed: Jun. 25, 2015

(65) Prior Publication Data

US 2016/0016407 A1 Jan. 21, 2016

(30) Foreign Application Priority Data

Jul. 16, 2014 (JP) ..... 2014-145551

(51) Int. Cl.
*B41J 2/175* (2006.01)
*B41J 2/165* (2006.01)

(52) U.S. Cl.
CPC ..... *B41J 2/175* (2013.01); *B41J 2/16526* (2013.01); *B41J 2/17596* (2013.01)

(58) Field of Classification Search
CPC ..... B41J 2/175; B41J 2/16526; B41J 2/17596
USPC ..... 347/6, 35
See application file for complete search history.

(56) References Cited

U.S. PATENT DOCUMENTS

2004/0090501 A1* 5/2004 Yoshida ..... B41J 2/175 347/85
2010/0182370 A1 7/2010 Nemoto et al.
2012/0026256 A1 2/2012 Shibata
2013/0029047 A1* 1/2013 Nakano ..... B41J 2/145 427/256
2013/0229467 A1* 9/2013 Brown ..... B41J 2/16526 347/85
2014/0071205 A1* 3/2014 Platt ..... B41J 2/175 347/54

FOREIGN PATENT DOCUMENTS

JP 2010-162783 A 7/2010
JP 2012-30516 A 2/2012
JP 2013-71410 A 4/2013

* cited by examiner

*Primary Examiner* — Jason Uhlenhake
(74) *Attorney, Agent, or Firm* — McDermott Will & Emery LLP

(57) ABSTRACT

A sub-tank is pressurized by a pump, with head valves closed. Then, one of the head valves is opened to perform a first purge on a first head. After the one head valve is closed, a different one of the head valves is opened to perform a second purge on a second head different from the first head. After these purges, an open-to-atmosphere valve is opened, with the head valves closed, to decrease the pressures inside the heads which are increased by the purges. This allows a selective purge on only a head which requires a purge. As a result, the amount of ink forced out is suppressed during the pressurized purges. After the sub-tank is made open to the atmosphere, a depressurizing pump depressurizes the sub-tank to form ink menisci in the heads. This prevents air bubbles from being drawn into nozzles during the formation of the ink menisci in the nozzles after the purges.

8 Claims, 19 Drawing Sheets

METHOD OF CONTROLLING LIQUID EJECTING APPARATUS AND LIQUID EJECTING APPARATUS

BACKGROUND OF THE INVENTION

1. Field of the Invention

The present invention relates to a method of controlling a liquid ejecting apparatus, and a liquid ejecting apparatus.

2. Description of the Background Art

An inkjet printer which records an image on a recording medium such as printing paper by ejecting minute ink droplets from a plurality of nozzles of a head unit toward the recording medium while moving the recording medium relative to the head unit has been hitherto used (as disclosed, for example, in Japanese Patent Application Laid-Open No. 2013-71410). An inkjet printer for color printing includes a plurality of head units corresponding to inks of respective colors and arranged in a direction in which the recording medium is moved relative to the head units.

In the inkjet printer disclosed in Japanese Patent Application Laid-Open No. 2013-71410, each of the head units for the respective colors includes a plurality of heads arranged in a staggered configuration and each having a plurality of nozzles. In a liquid ejecting apparatus, such as the aforementioned inkjet printer, which ejects liquid toward a recording medium, ink to be ejected toward the recording medium is held in a meniscus shape in each of the nozzles provided in the heads. If the ink is not ejected for a long period of time, a volatile ingredient contained in the ink vaporizes at each nozzle, so that the ink is increased in viscosity or is solidified. As a result, there is apprehension about ejection failures of ink from the nozzles and about unevenness in density of an image recorded on the recording medium.

If ink containing a precipitable ingredient is not ejected for a long period of time, there is apprehension that the precipitable ingredient is precipitated inside the heads and in ink flow passages, so that the flow passages are narrowed down.

To solve the aforementioned problems, there has been hitherto known a maintenance technique (what is called a purge) in which a positive pressure or a negative pressure is applied to the ink inside the heads to force the ink out of the nozzles of the heads, thereby ensuring the stable operation of the heads.

Japanese Patent Application Laid-Open No. 2012-30516 discloses a "pressurized purge" technique in which a positive pressure is developed inside a head to force ink in the head out of nozzles (for example, paragraphs 0043 to 0052).

Japanese Patent Application Laid-Open No. 2012-30516 also discloses a technique in which a supply valve is interposed in a supply flow passage which connects the head and a sub-tank and in which the supply valve is closed, and is then opened after the pressure inside the sub-tank is increased to a designated pressure, whereby pressure waves provided to the head during the pressurized purge are made sharp.

Japanese Patent Application Laid-Open No. 2010-162783 discloses what is called a "negative pressure purge" technique in which caps are brought into contact with nozzle surfaces of heads and suction pumps connected to the caps are driven to decrease the pressure in spaces defined by the nozzle surfaces and the caps, thereby forcing ink out of the nozzles by suction.

As disclosed in paragraphs 0050 to 0052 in Japanese Patent Application Laid-Open No. 2010-162783, a positive pressure is developed inside the heads by applying pressure to the interior of the heads during the negative pressure purge. This allows the negative pressure purge, with the positive pressure held in the heads. It is said that this prevents air bubbles from being drawn into the nozzles when the caps are separated after the negative pressure purge. It is also said that the pressure applied to the heads is cut off by closing a supply path shut-off valve interposed in a supply flow passage connecting a sub-tank and the heads after the pressure application to the heads, to return the pressure in the heads to atmospheric pressure, whereby ink is prevented from dripping down after the separation of the caps.

In an inkjet printer having a plurality of heads, it is ideal to discharge ink from the heads at the same flow rate during the aforementioned "pressurized purge" because the problems of ejection failures of ink and unevenness in density are solved to the same degree. However, there are differences in the amount of ink discharge during the "pressurized purge" between the heads in actuality because of the differences in flow passage resistance from the sub-tank between the heads. This gives rise to problems of unevenness in density during image recording and excess ink consumption during the pressurized purge.

An inkjet printer having a plurality of heads presents another problem. When it is desired to eliminate an ejection failure in a specific head, the apparatus configuration as disclosed, for example, in Japanese Patent Application Laid-Open No. 2010-162783 is required to conduct a purge on all of the heads. To conduct the purge on the heads which require no purge because no ejection failure occurs therein results in the extra ink consumption.

When ink menisci are formed in nozzles by decreasing the pressure inside the heads from the sub-tank side after the pressurized purge, there are cases in which air bubbles enter the ink at the nozzles. This might cause an ejection failure in such nozzles.

SUMMARY OF THE INVENTION

In view of the foregoing, it is an object of the present invention to reduce the amount of ink consumption during a pressurized purge in an inkjet printer having a plurality of heads.

To solve the aforementioned problems, a first aspect of the present invention is intended for a method of controlling a liquid ejecting apparatus for a recovery operation of a head unit, the liquid ejecting apparatus including the head unit having a plurality of heads each including a plurality of nozzles for ejecting a liquid, a liquid reservoir for temporarily storing the liquid for supply to the head unit, a plurality of supply passages for supplying the liquid from the liquid reservoir therethrough to the respective heads, and a plurality of open/close parts provided in the respective supply passages, the open/close parts being switchable between an open position independently ensuring the communication between the liquid reservoir and the heads and a closed position independently closing off the communication between the liquid reservoir and the heads. The method comprises the steps of: a) pressurizing the liquid inside the liquid reservoir to a state of positive pressure higher than atmospheric pressure, while maintaining all of the open/close parts in the closed position, to thereby performing pre-pressurization; b) bringing a first one of the open/close parts into the open position to perform a first purge, the step b) being performed after the step a); and c) making the liquid reservoir open to the atmosphere, the step c) being performed after the step b).

In the method according to the first aspect, a first one of the open/close parts is brought into the open position in the step b) of performing the first purge, whereby the liquid is forced out of one of the heads. This allows a selective purge of the head which requires a purge to thereby reduce the amount of consumption of ink during the purge.

In the method according to the first aspect, the step c) of making the liquid reservoir open to the atmosphere is performed after the step b) of performing the first purge. Thus, with the communication between the head brought into the open position in the step b) and the liquid reservoir provided through a supply passage, the liquid reservoir is made open to the atmosphere, so that the head is also made open to the atmosphere. This reduces the amount of consumption of ink ejected from the nozzles after the purge.

A second aspect of the present invention is intended for a liquid ejecting apparatus for ejecting a liquid onto a recording medium to record an image thereon. The liquid ejecting apparatus comprises: a head unit having a plurality of heads each including a plurality of nozzles for ejecting the liquid; a liquid reservoir for temporarily storing the liquid for supply to the head unit; a plurality of supply passages for supplying the liquid from the liquid reservoir therethrough to the respective heads; a plurality of open/close parts provided in the respective supply passages, the open/close parts being switchable between an open position independently ensuring the communication between the liquid reservoir and the heads and a closed position independently closing off the communication between the liquid reservoir and the heads; a pressurizing part for pressurizing the liquid inside the liquid reservoir; a depressurizing part for depressurizing the liquid inside the liquid reservoir; an open-to-atmosphere part for making the liquid inside the liquid reservoir open to the atmosphere; and a controller for controlling the switching of the open/close parts between the open position and the closed position, the pressurization of the liquid inside the liquid reservoir by means of the pressurizing part, the depressurization of the liquid inside the liquid reservoir by means of the depressurizing part, and the process of making the liquid inside the liquid reservoir open to the atmosphere by means of the open-to-atmosphere part, the controller performing the following operations: a pre-pressurization operation for pressurizing the liquid inside the liquid reservoir by means of the pressurizing part while maintaining all of the open/close parts in the closed position; a first purge operation for bringing a first one of the open/close parts into the open position after the pre-pressurization operation; and an open-to-atmosphere operation for making the liquid reservoir open to the atmosphere by means of the open-to-atmosphere part after the first purge operation.

In the liquid ejecting apparatus according to the second aspect, a first one of the open/close parts is brought into the open position in the first purge operation, whereby the liquid is forced out of one of the heads. This allows a selective purge of the head which requires a purge to thereby reduce the amount of consumption of ink during the purge.

In the liquid ejecting apparatus according to the second aspect, the open-to-atmosphere operation is performed after the first purge operation. Thus, with the communication between the head brought into the open position in the first purge operation and the liquid reservoir provided through a supply passage, the open-to-atmosphere part makes the liquid reservoir open to the atmosphere, so that the head is also made open to the atmosphere. This reduces the amount of consumption of ink ejected from the nozzles after the purge.

In this manner, the inkjet printer having the plurality of heads according to the present invention achieves the reduction in the amount of consumption of ink during the pressurized purge.

These and other objects, features, aspects and advantages of the present invention will become more apparent from the following detailed description of the present invention when taken in conjunction with the accompanying drawings.

DESCRIPTION OF THE PREFERRED EMBODIMENTS

Preferred embodiments according to the present invention will now be described with reference to the drawings. A direction in which a recording medium 7 to be described later is transported is referred to hereinafter as a "transport direction".

First Preferred Embodiment

A schematic configuration of a liquid ejecting apparatus 1 according to a first preferred embodiment of the present invention will be illustrated with reference to FIGS. 1 to 4. A coordinate system in which an XY plane is defined as a horizontal plane and a Z axis is defined to extend in a vertical direction is additionally shown, as appropriate, in FIGS. 1 to 3 for purposes of clarifying a directional relationship. In the coordinate system shown in FIGS. 1 to 3, directions pointed by the arrows shall be positive (+), and directions opposite from those pointed by the arrows shall be negative (−).

<1-1. Overall Configuration of Liquid Ejecting Apparatus>

Figure 1:
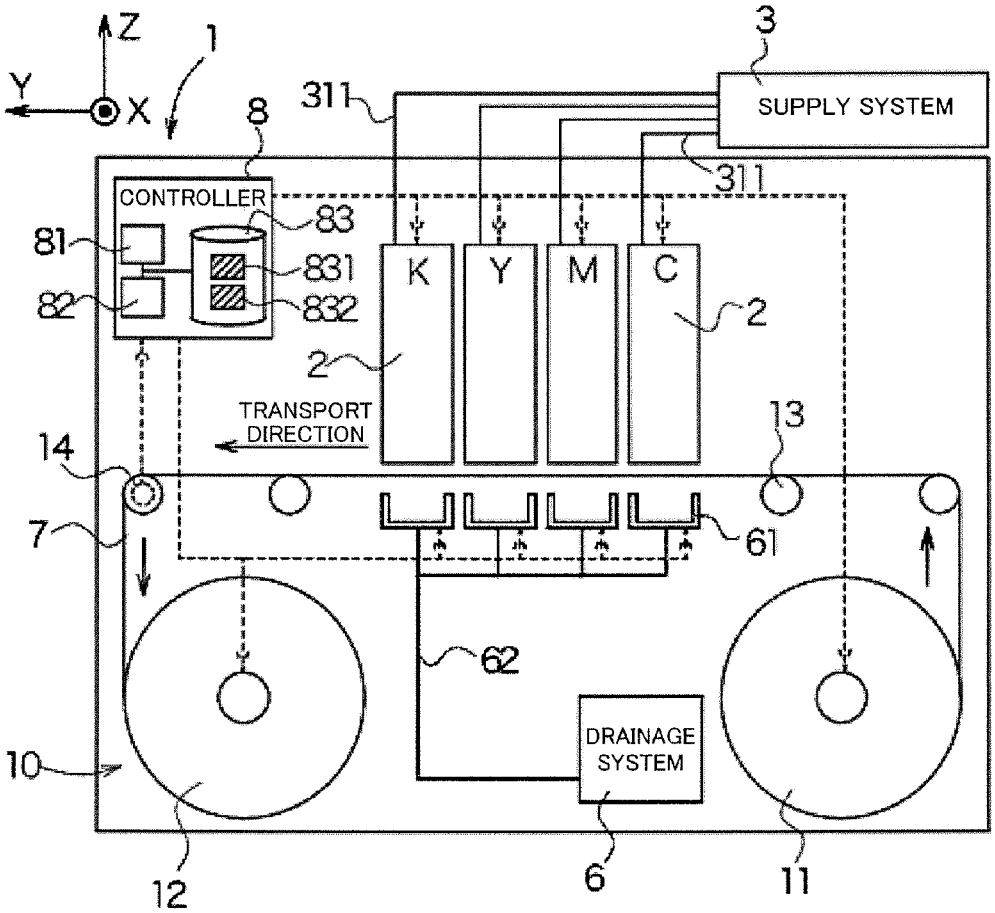
FIG. 1 is a side view schematically showing the configuration of a liquid ejecting apparatus according to a first preferred embodiment of the present invention.
Figure 2:
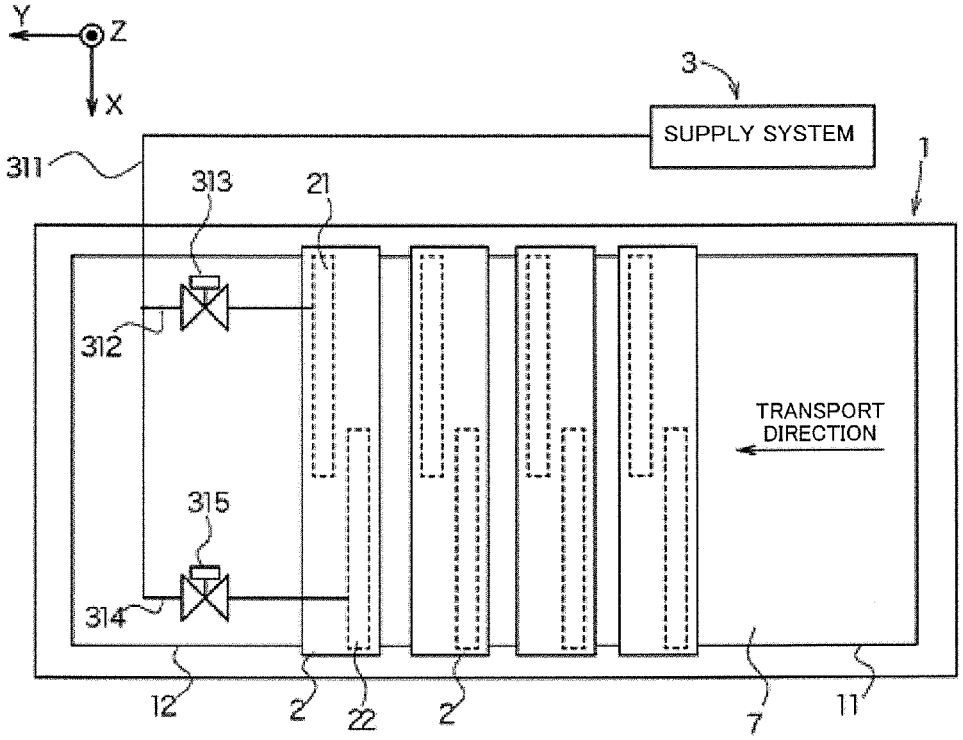
FIG. 2 is a plan view schematically showing the configuration of the liquid ejecting apparatus according to the first preferred embodiment.
Figure 3:
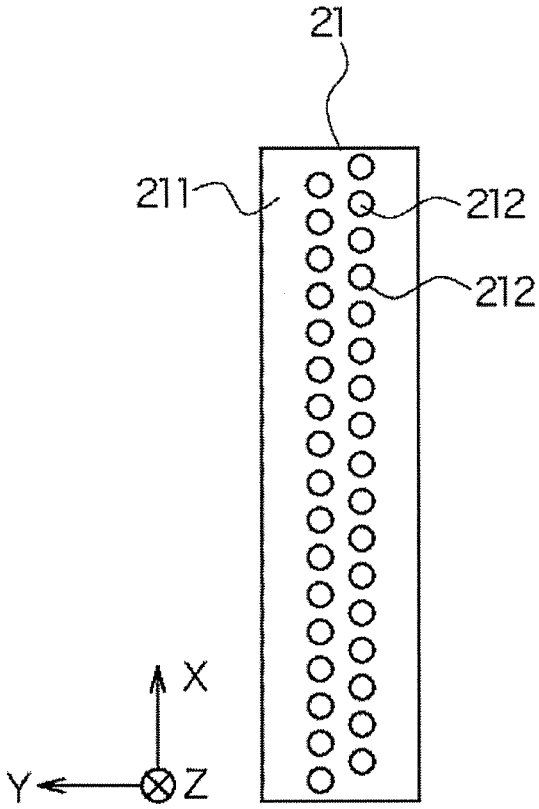
FIG. 3 is a bottom view schematically showing a head according to the first preferred embodiment.
Figure 4:
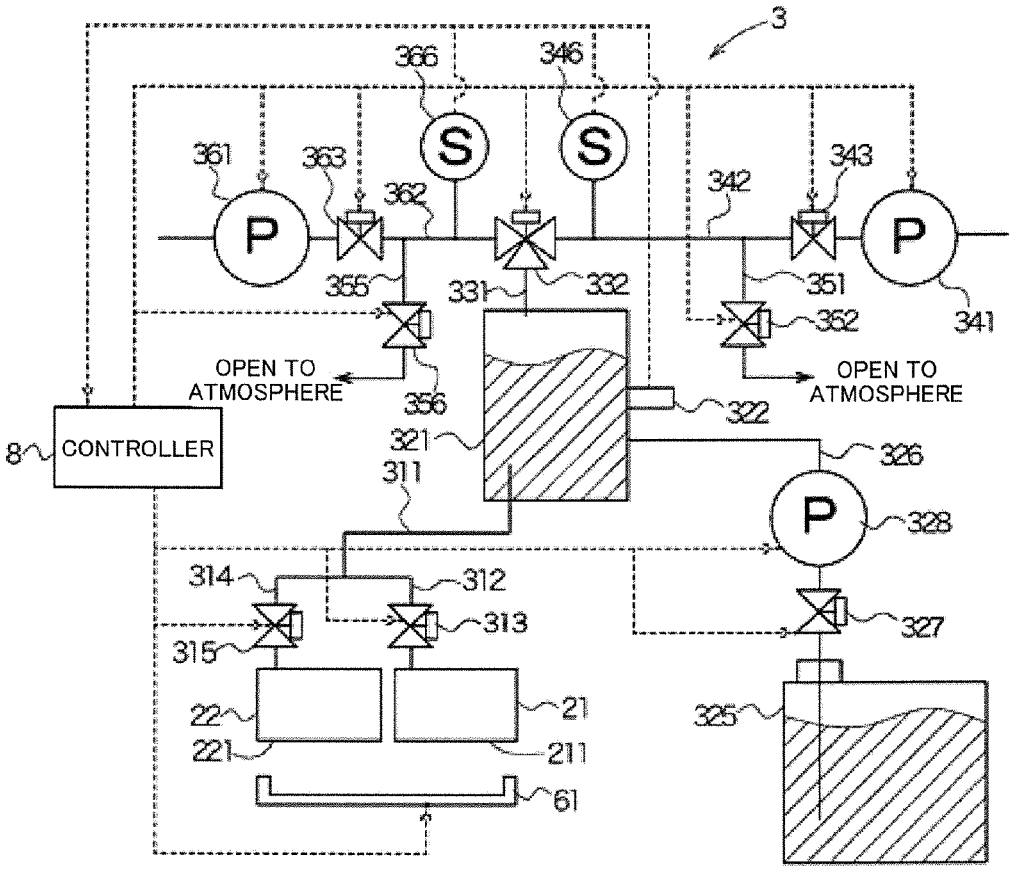
FIG. 4 is a block diagram showing an ink supply system according to the first preferred embodiment.

FIG. 1 is a side view schematically showing the configuration of the liquid ejecting apparatus 1. FIG. 2 is a plan view schematically showing the configuration of the liquid ejecting apparatus 1. FIG. 3 is a bottom view schematically showing a head which ejects ink. FIG. 4 is a block diagram showing an ink supply system.

The liquid ejecting apparatus 1 includes a transport mechanism 10 for transporting the recording medium 7 in the transport direction, a plurality of head units 2, a supply system 3 for supplying ink to the head units 2, cap members 61 opposed to the respective head units 2 during a recovery operation in which the maintenance of the head units 2 is carried out, and a drainage system 6 for collecting and draining ink ejected from the head units 2 during the recovery operation. The liquid ejecting apparatus 1 further includes a controller 8 for controlling the aforementioned components.

The liquid ejecting apparatus 1 is capable of performing an image recording step for recording an image on the recording medium 7, and a recovery step for carrying out the maintenance of the head units 2 in response to operating instructions from the controller 8. The liquid ejecting apparatus 1 is used as what is called a one-pass type inkjet recording apparatus which records a desired image on the recording medium 7 by ejecting ink droplets from the head units 2 while the recording medium 7 passes under the head units 2 only once.

The transport mechanism 10 includes a plurality of rollers 13 arranged in the Y direction and each extending in the X direction. An unwinder 11 which holds the recording medium 7 wound therearound in a roll form is provided on the negative Y (−Y) side of the rollers 13, and a winder 12 which holds the recording medium 7 wound therearound in a roll form is provided on the positive Y (+Y) side of the rollers 13. Each of the unwinder 11 and the winder 12 includes a motor (not shown), and is electrically connected to the controller 8.

At least one of the rollers 13 of the transport mechanism 10 is provided with an encoder 14 for detecting the transport speed of the recording medium 7 transported in the Y direction. The encoder 14 is electrically connected to the controller 8, and outputs the detected transport speed to the controller 8. The controller 8 controls the rotation of the motor of the winder 12, based on the output from the encoder 14, whereby the recording medium 7 is transported at a constant speed in the positive Y direction so as to pass under the head units 2.

During the transport of the recording medium 7, the motor of the unwinder 11 applies a load (tension) in the negative Y direction to the recording medium 7, so that the recording medium 7 over the rollers 13 is transported smoothly without becoming wavy.

The head units 2 are provided on the positive Z side of the transport mechanism 10 (i.e., over the transport mechanism 10) as seen in FIG. 1. When the controller 8 provides an image recording operation instruction to be described later to the head units 2, based on print data inputted from an external input device (not shown) such as a PC, the head units 2 performs the image recording step for ejecting ink toward the recording medium 7. When the controller 8 provides a recovery operation instruction to be described later to the head units 2, the head units 2 performs the recovery step for ejecting ink toward the cap members 61 to be described later.

In the first preferred embodiment, the liquid ejecting apparatus 1 includes the plurality of head units 2. As shown in FIG. 1, the four head units 2 are arranged in the Y direction, and supply ink of different colors, such as cyan (C), magenta (M), yellow (Y) and black (K) as seen from the negative Y side, to the recording medium 7. Only the head unit 2 for the K ink on the positive Y side will be described as a representative hereinafter because the four head units 2 are substantially similar in structure, in image recording step and in recovery step to each other except the colors of the ink.

The number of head units 2 is four in the first preferred embodiment, but is not limited to this for the practice of the present invention. The liquid ejecting apparatus 1 may include either one head unit 2 or not less than five head units 2. The colors of ink are not limited to the aforementioned four colors, but may include other colors, e.g. white, orange and green. The arrangement of the colors of ink is not limited to that described above. For example, the head units 2 may be arranged in the following order: Y, M, C and K as seen from the negative Y side.

As shown in plan view of FIG. 2, each of the head units 2 includes two heads: a first head 21 on the negative X side, and a second head 22 on the positive X side for purposes of convenience.

It will be assumed that each of the head units 2 includes two heads for the illustration of the first preferred embodiment. However, the number of heads in each head unit 2 is not limited to two for the practice of the present invention. Each head unit 2 may include not less than three heads. When each head unit 2 includes not less than three heads, the heads may be arranged in a staggered configuration in the Y direction.

The head units 2 used in the first preferred embodiment have a width approximately equal to the width of the recording medium 7 as measured in the X direction. The width of the head units 2 is not limited to this for the practice of the present invention. The head units 2 used in the present invention may have a width smaller or greater than the width of the recording medium 7 as measured in the X direction.

FIG. 3 is a bottom view schematically showing the configuration of the first head 21. The first head 21 has a nozzle surface 211 referred to as a bottom surface on the negative Z side and including a plurality of nozzles 212 for ejecting ink.

The nozzles 212 are arranged at equal spacings corresponding to a predetermined dot density in the X direction. The predetermined dot density is dependent on a resolution required for an image recorded on the recording medium 7. Examples of the predetermined dot density used are 360 dpi (dots per inch) and 720 dpi. A dot density of 720 dpi is used in the first preferred embodiment.

In the first preferred embodiment, the nozzles provided in first head 21 are aligned in two rows arranged in the Y direction and each including 17 nozzles arranged in the X direction, as shown in FIG. 3. The arrangement of the nozzles in first head 21 is not limited to this for the practice of the present invention. More nozzles may be provided in a single head. For example, 200 nozzles arranged at predetermined spacings in the X direction may be provided in a single head.

The first head 21 according to the first preferred embodiment is a head of what is called a piezoelectric type. The first head 21 includes a plurality of pressure chambers not shown, and a plurality of piezoelectric elements corresponding to the plurality of pressure chambers. The pressure chambers communicate with the respective nozzles 212. When an ejection signal that is an electric signal is sent from the controller 8 to each of the piezoelectric elements, each of the piezoelectric elements is deformed to exert pressure on the ink which fills a corresponding one of the pressure chambers. When the pressure in each pressure chamber is increased, the ink is ejected from a corresponding one of the nozzles 212.

The first head 21 according to the present invention is not limited to the head of the piezoelectric type. For example, the first head 21 according to the present invention may be what is called a thermal head which heats the ink in the pressure chambers by means of a heater to generate bubbles, thereby increasing the pressure in the pressure chambers.

The second head 22 is similar in internal configuration to the first head 21, and includes nozzles provided in the same manner as in the first head 21. For this reason, the bottom surface of the second head 22 is not shown.

In the aforementioned manner, the first head 21 and the second head 22 in the first preferred embodiment constitute "heads each including nozzles" in the present invention, and the head units 2 each including the first head 21 and the second head 22 constitute a "head unit" in the present invention.

Referring again to FIG. 1, the cap members 61 are described next. The cap members 61 include a cap moving mechanism not shown. The cap moving mechanism is electrically connected to the controller 8. In response to an operating instruction from the controller 8, the cap moving mechanism moves the cap members 61 between a separated position in which the cap members 61 are separated from the head units 2 and an opposed position in which the cap members 61 are opposed to the head units 2 to cover the nozzle surfaces 211 of the respective head units 2.

During a time period over which the head units 2 record no images on the recording medium 7, the cap members 61 are in the opposed position to cover the nozzle surfaces 211 having the nozzles 212 of the head units 2. This suppresses the vaporization of a solvent in the ink from ink meniscus surfaces formed in the nozzles 212 and the resultant solidification or agglomeration of ink near the nozzles 212 during the time period over which no images are recorded on the recording medium 7.

The cap members 61 are connected through piping 62 to the drainage system 6. When ink is ejected from the nozzles 212 while the cap members 61 in the opposed position cover the nozzles 212, the ink flows from the cap members 61 through the piping 62 to the drainage system 6. Thus, the ink is drained from the cap members 61.

The drainage system 6 includes a drain tank (not shown) and a drain pump (not shown). The ink ejected into the cap members 61 is sent by the drain pump through the piping 62 to the drain tank, and is stored in the drain tank.

In the case where the head units 2 record an image on the recording medium 7, the cap members 61 are placed in the separated position by the cap moving mechanism prior to the start of the image recording step. As shown in FIG. 1, the separated position is a position where the transport of the recording medium 7 is not prevented, and is on the negative Z side of the head units 2, with the recording medium 7 therebetween, in the first preferred embodiment.

The supply system 3 supplies ink to the head units 2. The details of the supply system 3 will be described later.

The recording medium 7 is an elongated strip-shaped sheet material having a surface which is opposed to the head units 2 and on which an image is to be recorded. A variety of materials may be used for the recording medium 7. Examples of the material of the recording medium 7 include paper such as plain paper and coated paper, resin films including polyethylene terephthalate (PET) and the like, metal such as an aluminum plate. In the first preferred embodiment, plain paper often used for inkjet liquid ejecting apparatuses is used as the recording medium 7. Although an elongated strip-shaped sheet material is used as the recording medium 7 in the first preferred embodiment, the shape of the recording medium 7 is not limited to this for the practice of the present invention. Flat sheets may be used as the recording medium 7 in the present invention.

The controller 8 controls the operations of the components of the liquid ejecting apparatus 1. As schematically shown in FIG. 1, the controller 8 according to the first preferred embodiment is formed by a computer including an arithmetic processor 81 such as a CPU, a memory 82 such as a RAM, and a storage part 83 such as a hard disk drive. As shown in FIGS. 1 and 4, the controller 8 is electrically connected to the transport mechanism 10, the four head units 2, the cap moving mechanism of the cap members 61 and components of the supply system 3 to be described later.

The controller 8 temporarily reads a computer program 831 and data 832 which are stored in the storage part 83 onto the memory 82. The arithmetic processor 81 performs arithmetic processing based on the computer program 831 and the data 832, so that the controller 8 controls the operations of the components of the liquid ejecting apparatus 1. Thus, the image recording step and the recovery step to be described later in the liquid ejecting apparatus 1 proceed. It should be noted that the controller 8 may be formed by electronic circuitry.

For the recording of an image based on print data on the upper surface of the recording medium 7 in the image recording step, the controller 8 controls the ejection of ink from the respective nozzles 212 by using the operating instructions provided to the head units 2. Thus, the controller 8 controls the ejection position and ejection rate of ink in the respective nozzles 212 in the image recording step.

The control of the ejection position of ink in the liquid ejecting apparatus 1 according to the first preferred embodiment is exercised by controlling the ejection timing of the ink from the nozzles 212. In the image recording step according to the first preferred embodiment, ink is ejected from the nozzles 212 while the controller 8 controls the unwinder 11 and the winder 12 in accordance with an input from the encoder 14 to transport the recording medium 7 at a constant speed in the transport direction. While passing under the head units 2, the recording medium 7 receives ink ejected from predetermined ones of the nozzles 212 of the head units 2. Thus, the impact positions of ink on the recording medium 7 in the transport direction are determined by the ejection timing of the ink from the nozzles 212.

In the first preferred embodiment, the ejection rate and ejection timing of ink are controlled by an ejection signal sent from the controller 8 to the piezoelectric elements. The controller 8 generates the ejection signal to be outputted to the piezoelectric elements, based on the print data inputted from an external input mechanism and positional information about the recording medium 7.

<1-2. Supply System>

Next, the configuration of the supply system 3 for supplying ink to the head units 2 will be described with reference to FIG. 4. FIG. 4 is a block diagram showing a peripheral configuration of the supply system 3. FIG. 4 shows the first head 21, the second head 22, the cap member 61 and the controller 8 in addition to the supply system 3.

The supply system 3 includes a main tank 325, a sub-tank 321, a pressurizing pump 341 and a depressurizing pump 361.

The main tank 325 is an ink tank or ink pouch for storing ink therein, and is replaceably disposed inside or outside the liquid ejecting apparatus 1. The main tank 325 is connected through a main pipe 326 to the sub-tank 321. A main valve 327 and a liquid feed pump 328 are interposed in the main pipe 326.

A known valve may be used as the main valve 327. The main valve 327 is electrically connected to the controller 8, and is switched between an open position and a closed position in response to an operating instruction from the controller 8. When the main valve 327 is in the open position, the main tank 325 and the sub-tank 321 communicate with each other. When the main valve 327 is in the closed position, the communication between the main tank 325 and the sub-tank 321 is closed off.

The liquid feed pump 328 is a pump for carrying the ink inside the main tank 325 to the sub-tank 321. A known pump may be used as the liquid feed pump 328. The liquid feed pump 328 is electrically connected to the controller 8. When the main valve 327 is brought into the open position while the liquid feed pump 328 is driven in response to an operating instruction from the controller 8, the ink stored in the main tank 325 is carried from the main tank 325 through the main pipe 326 to the sub-tank 321.

The sub-tank 321 is a tank for temporarily storing therein the ink for supply to the first head 21 and the second head 22, and constitutes a "liquid reservoir" according to the present invention. The sub-tank 321 includes a liquid level sensor 322.

The liquid level sensor 322 is a sensor for detecting the liquid level of the ink stored in the sub-tank 321. A known sensor may be used as the liquid level sensor 322. The liquid level sensor 322 is electrically connected to the controller 8, and inputs the result of detection of the liquid at a predetermined level in the sub-tank 321 as a signal to the controller 8.

Upon judging that the liquid level of the ink stored in the sub-tank 321 is lower than a predetermined first level, based on the signal from the liquid level sensor 322, the controller 8 brings the main valve 327 into the open position and drives the liquid feed pump 328. Upon judging that the liquid level of the ink stored in the sub-tank 321 is higher than a predetermined second level, based on the signal from the liquid level sensor 322, the controller 8 stops driving the liquid feed pump 328 and brings the main valve 327 into the closed position. Although the second level is higher than the first level in the first preferred embodiment, the first level and the second level may be at the same position. Thus, the liquid level in the sub-tank 321 is adjusted to within a predetermined fixed range.

The sub-tank 321 is connected through a pressure regulating pipe 331 to a three-way valve 332. A known three-way valve may be used as the three-way valve 332. The three-way valve 332 is connected to three pipes. Specifically, the three-way valve 332 is connected to a pressurizing pipe 342 in communication with the pressurizing pump 341 and a depressurizing pipe 362 in communication with the depressurizing pump 361 in addition to the pressure regulating pipe 331 in communication with the sub-tank 321. The three-way valve 332 is electrically connected to the controller 8, and is selectable between two pipe communicating states (i.e., a pressurizing pipe communicating state and a depressurizing pipe communicating state) in response to an operating instruction from the controller 8.

When the pressurizing pipe communicating state is selected by the controller 8, the pressure regulating pipe 331 and the pressurizing pipe 342 communicate with each other through the three-way valve 332, and the communication between the pressure regulating pipe 331 and the depressurizing pipe 362 is closed off.

When the depressurizing pipe communicating state is selected by the controller 8, the pressure regulating pipe 331 and the depressurizing pipe 362 communicate with each other through the three-way valve 332, and the communication between the pressure regulating pipe 331 and the pressurizing pipe 342 is closed off.

The sub-tank 321 is connected through a supply pipe 311 to a first branch pipe 312 and a second branch pipe 314. The first branch pipe 312 is connected to the first head 21, and a first head valve 313 is interposed in the first branch pipe 312. The second branch pipe 314 is connected to the second head 22, and a second head valve 315 is interposed in the second branch pipe 314. For distinction from the nozzle surface 211 of the first head 21 in expressive terms, the nozzle surface of the second head 22 is referred to as a "nozzle surface 221".

A known valve may be used as the first head valve 313. The first head valve 313 is electrically connected to the controller 8. The first head valve 313 is switched between an open position and a closed position in response to an operating instruction from the controller 8. When the first head valve 313 is in the open position, the first head 21 and the sub-tank 321 communicate with each other. When the first head valve 313 is in the closed position, the communication between the first head 21 and the sub-tank 321 is closed off.

A known valve may be used as the second head valve 315. The second head valve 315 is electrically connected to the controller 8. The second head valve 315 is switched between an open position and a closed position in response to an operating instruction from the controller 8. When the second head valve 315 is in the open position, the second head 22 and the sub-tank 321 communicate with each other. When the second head valve 315 is in the closed position, the communication between the second head 22 and the sub-tank 321 is closed off.

The first branch pipe 312 and the second branch pipe 314 in the first preferred embodiment constitute "supply passages" for supplying the liquid from the liquid reservoir (i.e., the sub-tank 321) to the heads (i.e., the first head 21 and the second head 22) in the aforementioned manner according to the present invention. The first head valve 313 and the second head valve 315 constitute "open/close parts" provided in the respective supply passages (i.e., the first branch pipe 312 and the second branch pipe 314) according to the present invention.

A pressurizing valve 343 is interposed in the pressurizing pipe 342 connecting the pressurizing pump 341 and the three-way valve 332 to each other. Part of the pressurizing pipe 342 which is closer to the three-way valve 332 with respect to the pressurizing valve 343 is branch-connected to an open-to-atmosphere pipe 351 and a pressure sensor 346 respectively.

A known valve may be used as the pressurizing valve 343. The pressurizing valve 343 is electrically connected to the controller 8. The pressurizing valve 343 is switched between an open position and a closed position in response to an operating instruction from the controller 8. When the pressurizing valve 343 is in the open position, the pressurizing pump 341 and the three-way valve 332 communicate with each other. When the pressurizing valve 343 is in the closed position, the communication between the pressurizing pump 341 and the three-way valve 332 is closed off.

A known pressurizing pump for applying pressure to a gas may be used as the pressurizing pump 341. The pressurizing pump 341 is electrically connected to the controller 8. When the pressurizing valve 343 is brought into the open position and the three-way valve 332 is brought into the pressurizing pipe communicating state while the pressurizing pump 341 is driven in response to an operating instruction from the controller 8, the interior of the sub-tank 321 is pressurized with a pressurized gas through the pressurizing pipe 342 and the pressure regulating pipe 331.

The pressurizing pump 341, the pressurizing valve 343, the pressurizing pipe 342, the three-way valve 332 and the pressure regulating pipe 331 in the first preferred embodiment constitute a "pressurizing part" for pressurizing the liquid reservoir (sub-tank 321) in the aforementioned according to the present invention.

The open-to-atmosphere pipe 351 has a first end connected to the pressurizing pipe 342, and a second end open to the atmosphere. An open-to-atmosphere valve 352 is interposed in the open-to-atmosphere pipe 351. A known valve may be used as the open-to-atmosphere valve 352. The open-to-atmosphere valve 352 is electrically connected to the controller 8. The open-to-atmosphere valve 352 is switched between an open position and a closed position in response to an operating instruction from the controller 8. When the open-to-atmosphere valve 352 is in the open position, the open-to-atmosphere pipe 351 and the pressurizing pipe 342 are open to the atmosphere. At this time, when the three-way valve 332 is brought into the pressurizing pipe communicating state, the gas and ink in the sub-tank 321 are also open to the atmosphere. When the open-to-atmosphere valve 352 is in the closed position, the communication between the open-to-atmosphere pipe 351 and pressurizing pipe 342, and the second end of the open-to-atmosphere pipe 351 open to the atmosphere is closed off, so that the open-to-atmosphere pipe 351 and the pressurizing pipe 342 are not open to the atmosphere.

The open-to-atmosphere pipe 351, the open-to-atmosphere valve 352, the pressurizing pipe 342, the three-way valve 332 and the pressure regulating pipe 331 in the first preferred embodiment constitute an "open-to-atmosphere part" for making the liquid reservoir (sub-tank 321) open to the atmosphere in the aforementioned manner according to the present invention.

The pressure sensor 346 is a sensor for detecting the pressure of a gas inside the pressurizing pipe 342. A known sensor may be used as the pressure sensor 346. The pressure sensor 346 is electrically connected to the controller 8, and inputs the result of detection as a signal to the controller 8.

A depressurizing valve 363 is interposed in the depressurizing pipe 362 connecting the depressurizing pump 361 and the three-way valve 332 to each other. Part of the depressurizing pipe 362 which is closer to the three-way valve 332 with respect to the depressurizing valve 363 is branch-connected to an open-to-atmosphere pipe 355 and a pressure sensor 366 respectively.

A known valve may be used as the depressurizing valve 363. The depressurizing valve 363 is electrically connected to the controller 8. The depressurizing valve 363 is switched between an open position and a closed position in response to an operating instruction from the controller 8. When the depressurizing valve 363 is in the open position, the depressurizing pump 361 and the three-way valve 332 communicate with each other. When the depressurizing valve 363 is in the closed position, the communication between the depressurizing pump 361 and the three-way valve 332 is closed off.

A known depressurizing pump for reducing the pressure of a gas may be used as the depressurizing pump 361. The depressurizing pump 361 is electrically connected to the controller 8. When the depressurizing valve 363 is brought into the open position and the three-way valve 332 is brought into the depressurizing pipe communicating state while the depressurizing pump 361 is driven in response to an operating instruction from the controller 8, the interior of the sub-tank 321 is depressurized with a depressurized gas through the depressurizing pipe 362 and the pressure regulating pipe 331.

The depressurizing pump 361, the depressurizing valve 363, the depressurizing pipe 362, the three-way valve 332 and the pressure regulating pipe 331 in the first preferred embodiment constitute a "depressurizing part" for depressurizing the liquid reservoir (sub-tank 321) in the aforementioned according to the present invention.

The open-to-atmosphere pipe 355 has a first end connected to the depressurizing pipe 362, and a second end open to the atmosphere. An open-to-atmosphere valve 356 is interposed in the open-to-atmosphere pipe 355. A known valve may be used as the open-to-atmosphere valve 356. The open-to-atmosphere valve 356 is electrically connected to the controller 8. The open-to-atmosphere valve 356 is switched between an open position and a closed position in response to an operating instruction from the controller 8. When the open-to-atmosphere valve 356 is in the open position, the open-to-atmosphere pipe 355 and the depressurizing pipe 362 are open to the atmosphere. When the open-to-atmosphere valve 356 is in the closed position, the communication between the open-to-atmosphere pipe 355 and depressurizing pipe 362, and the second end of the open-to-atmosphere pipe 355 open to the atmosphere is closed off, so that the open-to-atmosphere pipe 355 and the depressurizing pipe 362 are not open to the atmosphere.

The pressure sensor 366 is a sensor for detecting the pressure of a gas inside the depressurizing pipe 362. A known sensor may be used as the pressure sensor 366. The pressure sensor 366 is electrically connected to the controller 8, and inputs the result of detection as a signal to the controller 8.

In the first preferred embodiment, the sub-tank 321 is disposed above the first head 21 and the second head 22. For the formation of ink menisci in the nozzles 212 of the first head 21 and the second head 22, it is hence necessary that the pressure inside the first head 21 and the second head 22 is regulated to a negative pressure lower than atmospheric pressure.

In the first preferred embodiment, the first head valve 313 and the second head valve 315 are brought into the open position, and the depressurizing pump 361 is used to depressurize the sub-tank 321 in the aforementioned manner, whereby ink in the first head 21 and the second head 22 is at the negative pressure. This allows the formation of ink menisci in the nozzles 212.

At this time, if the sub-tank 321 is excessively depressurized, there is apprehension that air bubbles are drawn into the nozzles 212. To prevent this, the controller 8 controls the driving of the depressurizing pump 361 and the open position of the depressurizing valve 363 or the open-to-atmosphere valve 356, based on the value of pressure detected by the pressure sensor 366, to thereby regulate the negative pressure inside the first head 21 and the second head 22.

The supply system 3 and the peripheral configuration thereof are described above. The liquid ejecting apparatus 1 according to the first preferred embodiment further includes a timer not shown. The timer measures the amount of time elapsed since an operating instruction was provided for the control of each component. For example, the timer measures the amount of time elapsed since the transition was made from the closed position to the open position in each of the valves such as the pressurizing valve 343. The timer is electrically connected to the controller 8, and the results of measurement are written one by one in the memory 82 of the controller 8.

<1-3. Recovery Step>

Figure 5:
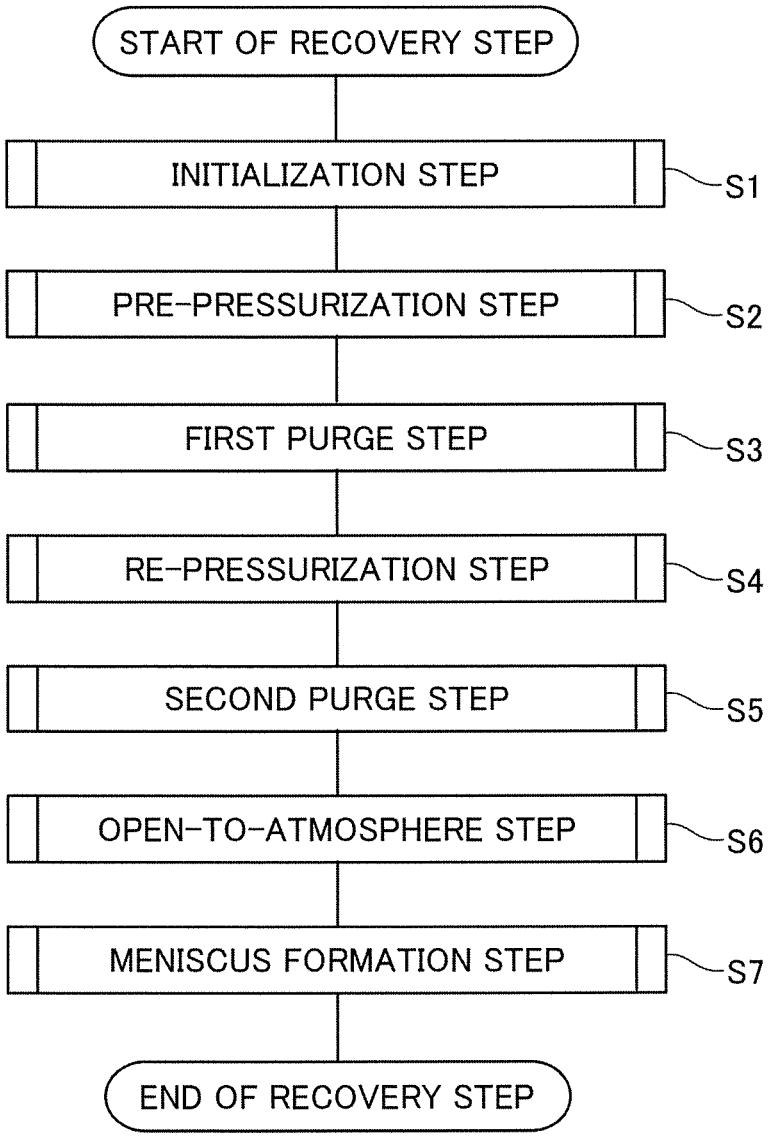
FIG. 5 is a flow diagram showing a recovery step according to the first preferred embodiment.

Next, the recovery step of the first head 21 and the second head 22 in the liquid ejecting apparatus 1 according to the first preferred embodiment will be described. FIG. 5 is a flow diagram of the recovery step according to the first preferred embodiment. FIGS. 6 to 12 are flow diagrams of steps included in the recovery step according to the first preferred embodiment. FIG. 13 is a timing diagram of the recovery step according to the first preferred embodiment.

Immediately before the execution of the recovery step, the liquid ejecting apparatus 1 is in a state of what is called a "waiting time period" during which no images are recorded on the recording medium 7 (i.e., the image recording step is not being executed).

During the waiting time period, the liquid ejecting apparatus 1 brings the depressurizing valve 363, the first head valve 313 and the second head valve 315 into the open position, and brings the three-way valve 332 into the depressurizing pipe communicating state while driving the depressurizing pump 361. This forms ink menisci in the nozzles 212 to maintain the ink not dripping down from the nozzles 212. At this time, the open-to-atmosphere valve 356 is in the closed position.

In the liquid ejecting apparatus 1 according to the first preferred embodiment, if ink is not ejected from the nozzles 212 of the first head 21 and the second head 22 for a long period of time (i.e., the aforementioned "waiting time period" continues for a long period of time), there is apprehension that a volatile ingredient contained in the ink vaporizes, so that the ink is increased in viscosity or is solidified. This might cause ejection failures of the ink from the nozzles 212 and unevenness in density of an image recorded on the recording medium 7.

If the ink used in the liquid ejecting apparatus 1 contains a precipitable ingredient and is not ejected for a long period of time, there is apprehension that the precipitable ingredient is precipitated in places where the ink is stored and places serving as flow passages of ink, such as the first head 21, the second head 22, the first branch pipe 312, the second branch pipe 314, the supply pipe 311 and the interior of the sub-tank 321. This might result in the problems that there arises unevenness in density of an image recorded on the recording medium 7 and that the flow passages of the ink are narrowed down.

To solve the problems as described above, the liquid ejecting apparatus 1 according to the first preferred embodiment performs the recovery step to be described below in response to a recovery operation instruction from the controller 8. Specifically, the liquid ejecting apparatus 1 cleans the interiors of the heads by performing a "pressurized purge" in which pressure is applied to the ink in the first head 21 and the second head 22 in sequential order to force the ink out of the nozzles 212 of the first head 21 and the second head 22 toward the cap members 61.

The recovery step according to the first preferred embodiment will be described with reference to the flow diagram of FIG. 5 as appropriate. First, upon selecting the computer program 831 relating to the recovery operation stored in the storage part 83, the controller 8 instructs the components of the liquid ejecting apparatus 1 to perform a recovery process. Thus, the liquid ejecting apparatus 1 performs operations to be described below.

The selection of the computer program 831 in the controller 8 may be made by inputting from a manipulation part not shown in the liquid ejecting apparatus 1 or upon being triggered by detecting that ink has not been ejected from the nozzles 212 for a fixed period of time by means of the timer not shown in the liquid ejecting apparatus 1. Alternatively, an appropriate computer program 831 may be selected from among a plurality of computer programs 831 relating to the recovery process in accordance with conditions of the recovery operation. For example, computer programs 831 different from each other in the amount of ink forced out in first and second purge steps to be described later may be prepared, so that a computer program 831 which provides an appropriate amount of ink forced out is selected in accordance with the length of the "waiting time period" immediately before the execution of the recovery step.

In the recovery operation instruction from the controller 8, the controller 8 initially executes an initialization operation instruction upon the liquid ejecting apparatus 1. Thus, the liquid ejecting apparatus 1 performs an initialization step (Step S1) for setting each of the components thereof at its initial position for the recovery process.

Figure 6:
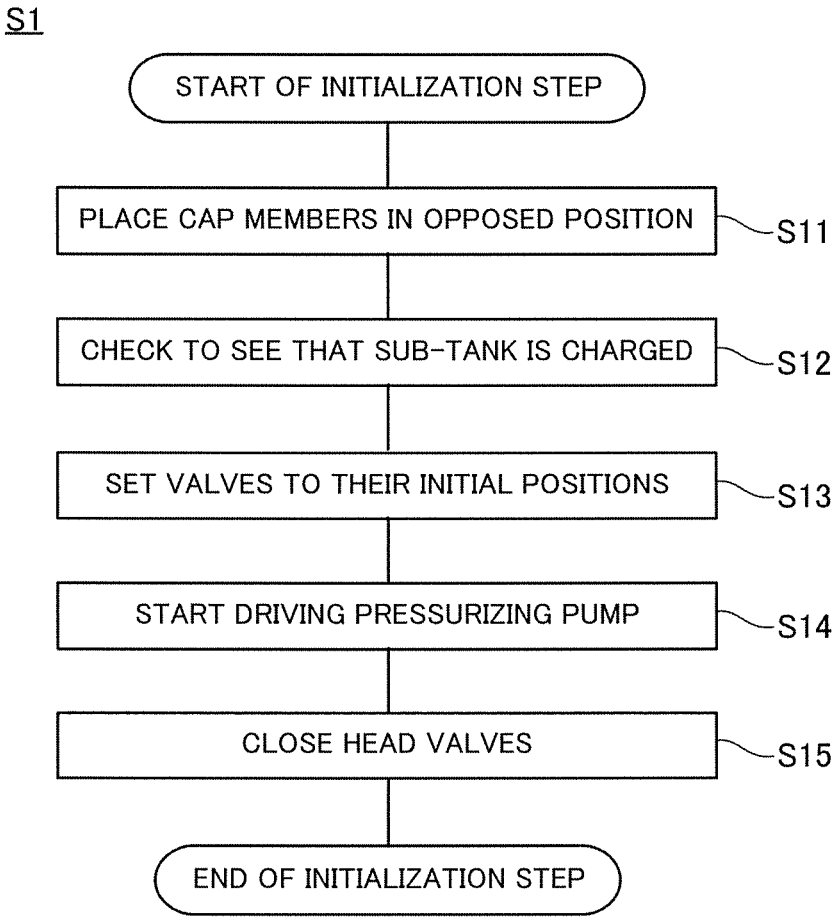
FIG. 6 is a flow diagram showing an initialization step according to the first preferred embodiment.

FIG. 6 is a flow diagram showing the details of the initialization step. Upon starting to perform the initialization step, the controller 8 initially provides an operating instruction to the cap moving mechanism not shown, thereby placing the cap members 61 in the opposed position which is opposed to the nozzle surfaces 211 and 221 of the first and second heads 21 and 22 (Step S11). When the cap members 61 are already in the opposed position, the opposed position of the cap members 61 is maintained.

Next, the controller 8 checks to see that the liquid level of the ink stored in the sub-tank 321 is within a predetermined fixed range, based on a signal from the liquid level sensor 322 (Step S12). Upon judging that the liquid level of the ink is not within the fixed range (specifically, that the liquid level of the ink is lower than the predetermined first level), the controller 8 brings the main valve 327 into the open position and drives the liquid feed pump 328 to carry the ink from the main tank 325 to the sub-tank 321. Then, upon judging that the liquid level of the ink becomes higher than the predetermined second level, based on the signal from the liquid level sensor 322, the controller 8 stops driving the liquid feed pump 328 and brings the main valve 327 into the closed position to stop carrying the ink.

As described above, the step of checking the amount of ink stored in the sub-tank 321 is performed before a purge step to be described below. This prevents changes in purge conditions resulting from the charging of ink into the sub-tank 321 in the course of forcing ink from the heads in the purge step.

After checking the charging of ink into the sub-tank 321 in Step S12, the controller 8 next sets the opening and closing of the valves at respective locations of the supply system 3 to their initial positions for the recovery process (Step S13). In Step S13, the controller 8 provides an operating instruction to bring the first head valve 313, the second head valve 315 and the depressurizing valve 363 into the open position. Specifically, when these valves are already in the open position, the open position thereof is maintained. The valves in the closed position, if any, are changed to the open position. The three-way valve 332 is maintained in the depressurizing pipe communicating state. The pressurizing valve 343, the open-to-atmosphere valves 352 and 356, and the main valve 327 are brought into the closed position.

Next, the controller 8 checks to see that the pressurizing valve 343 is in the closed position, and drives the pressurizing pump 341 (Step S14). Thus, the gas in part of the pressurizing pipe 342 extending from the pressurizing pump 341 to the pressurizing valve 343 is pressurized to a predetermined pressure.

Next, the controller 8 brings the first head valve 313 and the second head valve 315 to the closed position (Step S15). This completes the initialization step.

The aforementioned steps (Steps S11 to S15) included in the initialization step need not be performed in the aforementioned order. The order of the aforementioned steps (Steps S11 to S15) may be changed, as appropriate, or be performed at the same time without inconsistencies.

After the initialization step is completed, the liquid ejecting apparatus 1 next performs a pre-pressurization step (Step S2) for pressurizing the ink stored in the sub-tank 321 for pre-pressurization while the first head valve 313 and the second head valve 315 remain in the closed position.

Figure 7:
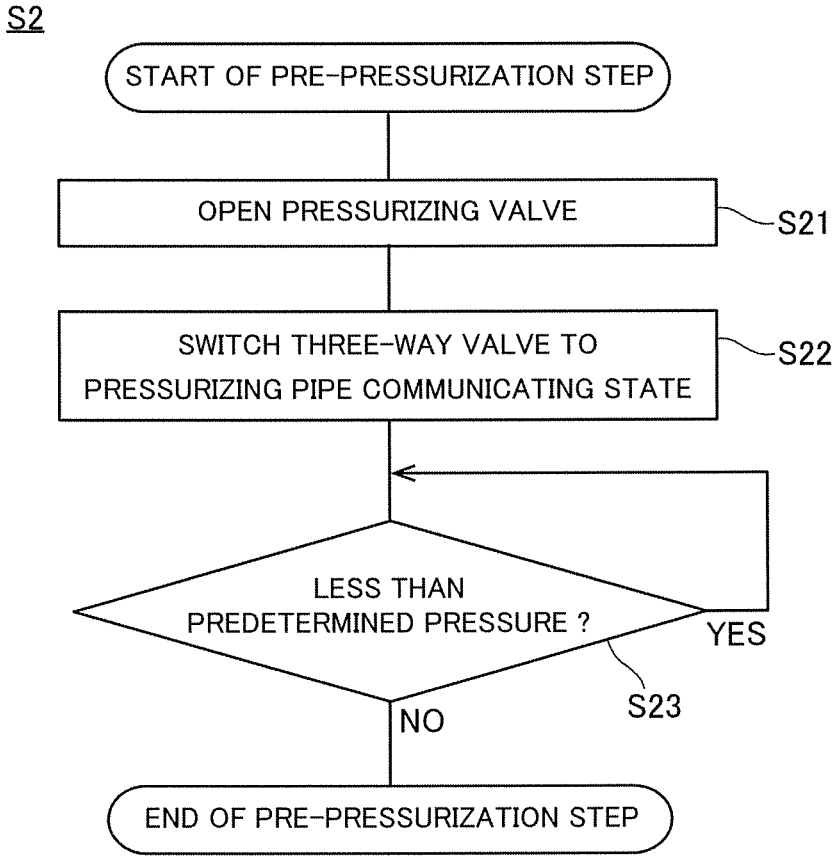
FIG. 7 is a flow diagram showing a pre-pressurization step according to the first preferred embodiment.

FIG. 7 is a flow diagram showing the details of the pre-pressurization step. Upon starting to perform the pre-pressurization step, the controller 8 initially provides an operating instruction to bring the pressurizing valve 343 into the open position (Step S21). Next, the controller 8 switches the three-way valve 332 to the pressurizing pipe communicating state (Step S22). This causes the gas inside the pressurizing pipe 342 pressurized by driving the pressurizing pump 341 to pressurize the ink stored in the sub-tank 321, so that the ink in the sub-tank 321, the supply pipe 311, part of the first branch pipe 312 closer to the supply pipe 311 with respect to the first head valve 313 and part of the second branch pipe 314 closer to the supply pipe 311 with respect to the second head valve 315 are brought into a state of positive pressure higher than atmospheric pressure.

Next, the controller 8 performs a first pressure monitoring step (Step S23) for judging whether the pressure inside the pressurizing pipe 342 in communication with the sub-tank 321 is less than a predetermined pressure (referred to hereinafter as a "first pressure") or not, based on a signal from the pressure sensor 346. Upon judging that the pressure inside the pressurizing pipe 342 is not less than the first pressure, the controller 8 then completes the pre-pressurization step, and performs a first purge step (Step S3) for performing a first purge.

Figure 8:
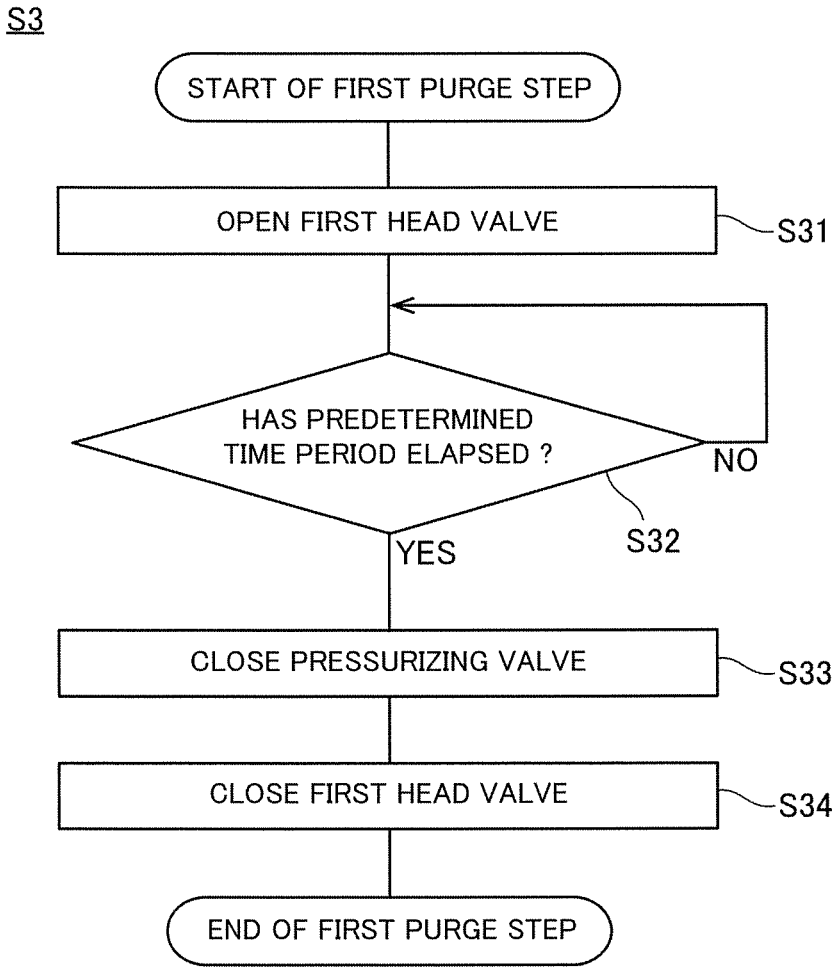
FIG. 8 is a flow diagram showing a first purge step according to the first preferred embodiment.

FIG. 8 is a flow diagram showing the details of the first purge step. Upon starting the first purge step, the controller 8 initially provides an operating instruction to bring the first head valve 313 into the open position (Step S31). This causes the supply pipe 311 and the sub-tank 321 which are brought into the state of positive pressure by the pre-pressurization step (Step S2) to communicate with the first head 21. Thus, the ink inside the first head 21 is brought into the state of positive pressure, so that the ink is forced out of the nozzles 212 of the first head 21. That is, the opening of the first head valve 313 starts the pressurized purge in the first head 21.

Forcing the ink out of the nozzles 212 of the first head 21 in the aforementioned manner eliminates the problems of the increased viscosity and solidification of ink in the nozzles 212 of the first head 21. Also, when the ink contains a precipitable ingredient, this eliminates the problem of the precipitation of the ink inside the first head 21.

After the first head valve 313 is brought into the open position, the timer not shown measures the amount of time elapsed since the first head valve 313 was brought into the open position. The value measured by the timer is inputted as a signal to the controller 8. The controller 8 judges whether a predetermined time period has elapsed since the first head valve 313 was brought into the open position or not (Step S32). When the controller 8 judges in Step S32 that the predetermined time period has elapsed (i.e., the answer to Step S32 is YES), the pressurizing valve 343 is brought into the closed position (Step S33), and the first head valve 313 is brought into the closed position (Step S34). This completes the first purge step (Step S3).

In the flow diagram of FIG. 8, the first head valve 313 is closed (Step S34) after the pressurizing valve 343 is closed (Step S33). However, the order in which these valves are closed is not limited to this for the practice of the present invention. The first head valve 313 may be brought into the closed position before the pressurizing valve 343. Alternatively, the pressurizing valve 343 and the first head valve 313 may be brought into the closed position at the same time.

When the controller 8 brings the first head valve 313 into the closed position in Step S34, the ink inside the first head 21 and the ink inside the supply pipe 311 are isolated from each other, so that the ink inside the sub-tank 321 and the ink inside the supply pipe 311 stop pressurizing the ink inside the first head 21. After the pressurization stops, the ink inside the first head 21 continues to be ejected from the nozzles 212 of the first head 21. Thus, the pressure of the ink inside the first head 21 decreases gradually from the state of positive pressure toward atmospheric pressure.

Referring again to FIG. 5, the liquid ejecting apparatus 1 performs a re-pressurization step (Step S4) after the first purge step is completed. The re-pressurization step in Step S4 is substantially the same as the pre-pressurization step in Step S2. The re-pressurization step pressurizes the ink inside the sub-tank 321 again to a predetermined pressure, with the communication between the first and second heads 21 and 22 and the sub-tank 321 closed off.

Figure 9:
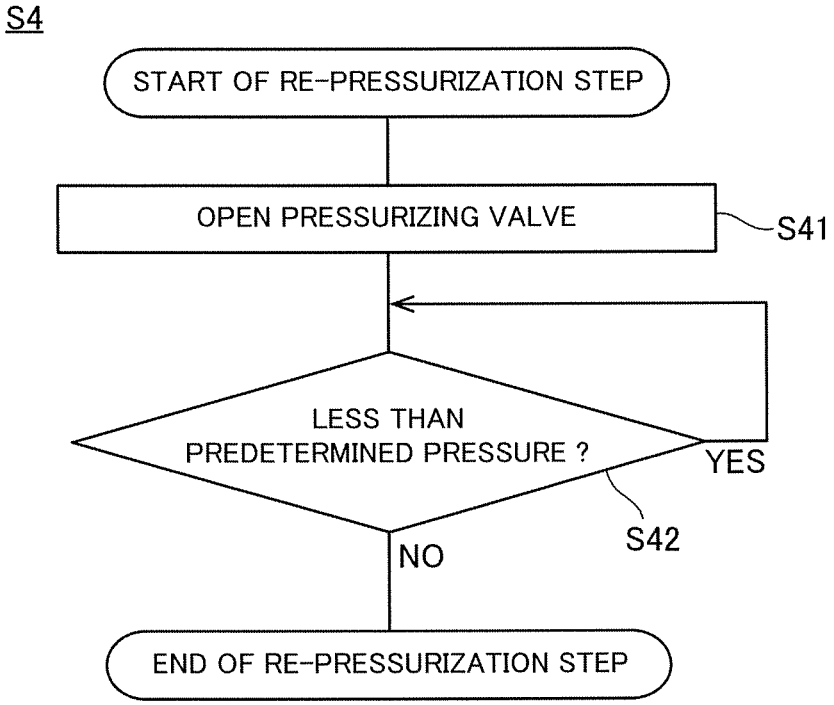
FIG. 9 is a flow diagram showing a re-pressurization step according to the first preferred embodiment.

FIG. 9 is a flow diagram showing the details of the re-pressurization step. Upon starting the re-pressurization step, the controller 8 initially provides an operating instruction to bring the pressurizing valve 343 into the open position and to maintain the pressurizing pipe communicating state of the three-way valve 332 (Step S41). Next, the controller 8 performs a first pressure monitoring step (Step S42) for judging whether the pressure inside the pressurizing pipe 342 in communication with the sub-tank 321 is less than a predetermined pressure (which is the "first pressure" identical with that in the pre-pressurization step in the first preferred embodiment) or not, based on a signal from the pressure sensor 346. Upon judging that the pressure inside the pressurizing pipe 342 is not less than the first pressure, the controller 8 then completes the re-pressurization step, and performs the next step, i.e. a second purge step (Step S5).

In the first preferred embodiment, the ink inside the sub-tank 321 is pressurized to the first pressure both in the pre-pressurization step (Step S2) and in the re-pressurization step (Step S4). However, the pressurization of the ink inside the sub-tank 321 is not limited to this for the practice of the present invention. The ink inside the sub-tank 321 may be pressurized to pressures different between the pre-pressurization step and the re-pressurization step. In the case where the use of the same pressure causes a difference between the amount of ink ejected in the first purge step and the amount of ink ejected in the second purge step to be described below because of a difference in flow passage resistance from the sub-tank 321 between the first head 21 and the second head 22 and the like, the sub-tank 321 may be pressurized to the first pressure in the pre-pressurization step whereas the sub-tank 321 is pressurized to a second pressure different from the first pressure in the re-pressurization step for the purpose of making the amounts of ejected ink equal to each other.

After the re-pressurization step (Step S4) is completed, the second purge step (Step S5) is performed which brings the second head valve 315 into the open position to force ink out of the nozzles 212 of the second head 22, thereby performing a second purge.

Figure 10:
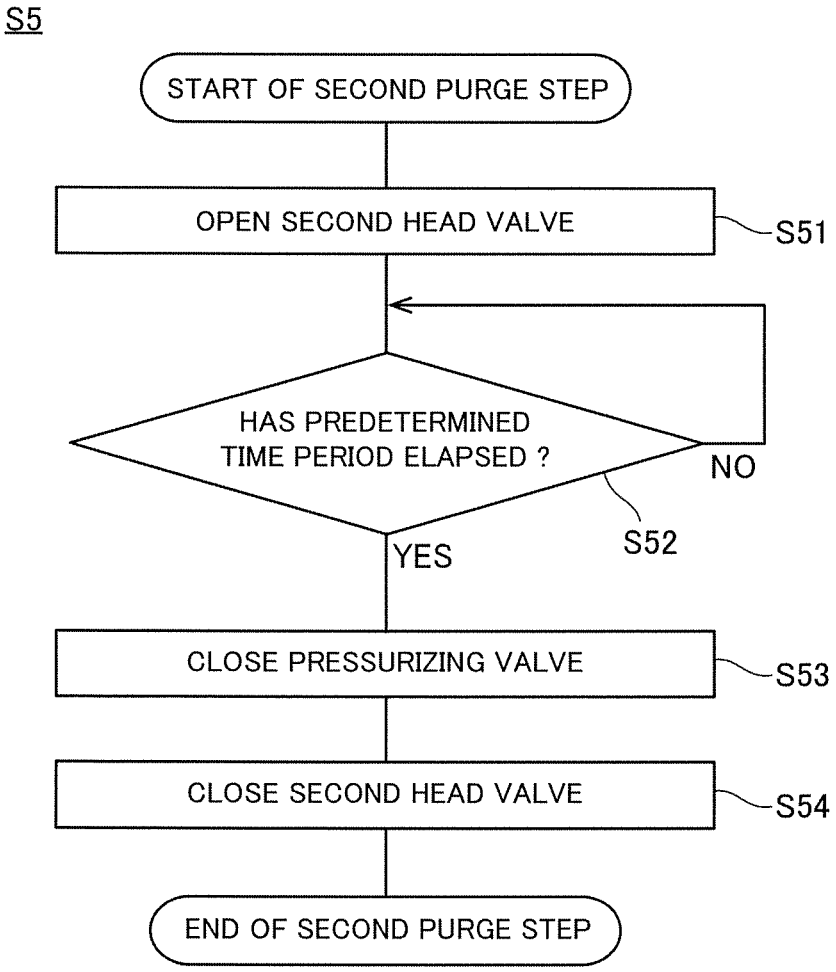
FIG. 10 is a flow diagram showing a second purge step according to the first preferred embodiment.

FIG. 10 is a flow diagram showing the details of the second purge step. Upon starting the second purge step, the controller 8 initially provides an operating instruction to bring the second head valve 315 into the open position (Step S51). This causes the supply pipe 311 and the sub-tank 321 which are brought into the state of positive pressure by the re-pressurization step (Step S4) to communicate with the second head 22. Thus, the ink inside the second head 22 is brought into the state of positive pressure, so that the ink is forced out of the nozzles 212 of the second head 22. That is, the opening of the second head valve 315 starts the pressurized purge in the second head 22.

Forcing the ink out of the nozzles 212 of the second head 22 in the aforementioned manner eliminates the problems of the increased viscosity and solidification of ink in the nozzles 212 of the second head 22. Also, when the ink contains a precipitable ingredient, this eliminates the problem of the precipitation of the ink inside the second head 22.

After the second head valve 315 is brought into the open position, the timer not shown measures the amount of time elapsed since the second head valve 315 was brought into the open position. The value measured by the timer is inputted as a signal to the controller 8. The controller 8 judges whether a predetermined time period has elapsed since the second head valve 315 was brought into the open position or not (Step S52). When the controller 8 judges in Step S52 that the predetermined time period has elapsed (i.e., the answer to Step S52 is YES), the pressurizing valve 343 is brought into the closed position (Step S53), and the second head valve 315 is brought into the closed position (Step S54). This completes the second purge step (Step S5).

In the flow diagram of FIG. 10, the second head valve 315 is closed (Step S54) after the pressurizing valve 343 is closed (Step S53). However, the order in which these valves are closed is not limited to this for the practice of the present invention. The second head valve 315 may be brought into the closed position before the pressurizing valve 343. Alternatively, the pressurizing valve 343 and the second head valve 315 may be brought into the closed position at the same time.

When the controller 8 brings the second head valve 315 into the closed position in Step S54, the ink in the second head 22 and the ink in the supply pipe 311 are isolated from each other, so that the ink inside the sub-tank 321 and the supply pipe 311 stops pressurizing the ink inside the second head 22. After the pressurization stops, the ink inside the second head 22 continues to be ejected from the nozzles 212 of the second head 22. Thus, the pressure of the ink inside the second head 22 decreases gradually from the state of positive pressure toward atmospheric pressure.

Referring again to FIG. 5, after the second purge step (Step S5) is completed whereby the pressurized purges of the first head 21 and the second head 22 in each head unit 2 are completed, an open-to-atmosphere step (Step S6) is next performed which reduces the pressure of the ink inside the first head 21 and the second head 22.

Figure 11:
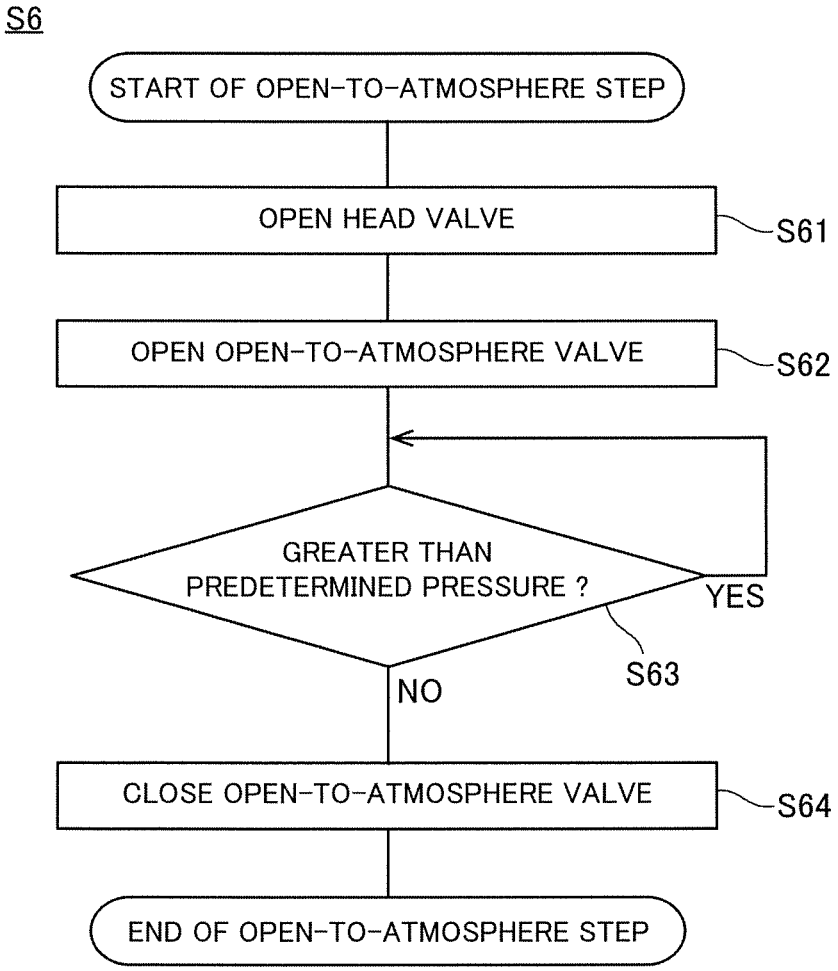
FIG. 11 is a flow diagram showing an open-to-atmosphere step according to the first preferred embodiment.

FIG. 11 is a flow diagram showing the details of the open-to-atmosphere step. Upon starting the open-to-atmosphere step, the controller 8 initially provides an operating instruction to bring the first head valve 313 and the second head valve 315 into the open position (Step S61). This causes the supply pipe 311 and the sub-tank 321 to communicate with the first head 21 and the second head 22.

Next, the controller 8 provides an operating instruction to bring the open-to-atmosphere valve 352 into the open position (Step S62). This causes the ink inside the first and second heads 21 and 22 caused to communicate with the sub-tank 321 in Step S61 to be open to the atmosphere through the pressure regulating pipe 331, the pressurizing pipe 342 and the open-to-atmosphere pipe 351. Thus, the pressure of the ink inside the first head 21 and the second head 22 which is brought into the state of positive pressure in the first purge step and the second purge step decreases gradually toward atmospheric pressure.

Next, the controller 8 judges whether the pressure inside the pressurizing pipe 342 in communication with the sub-tank 321 is greater than a predetermined pressure (which is atmospheric pressure in the first preferred embodiment) or not, based on a signal from the pressure sensor 346 (Step S63). Upon judging that the pressure inside the pressurizing pipe 342 is not greater than atmospheric pressure, the controller 8 then brings the open-to-atmosphere valve 352 into the closed position (Step S64) to complete the open-to-atmosphere step.

In judging whether the pressure inside the pressurizing pipe 342 is greater than a predetermined pressure or not in Step S63, the predetermined pressure as used in the first preferred embodiment is atmospheric pressure. However, the predetermined pressure is not limited to atmospheric pressure for the practice of the present invention. A pressure higher than atmospheric pressure and lower than the first pressure in the pre-pressurization step and the re-pressurization step may be used as the aforementioned predetermined pressure.

Referring again to FIG. 5, after the open-to-atmosphere step (Step S6) is completed whereby the pressure of the ink inside the first head 21 and the second head 22 of each head unit 2 is decreased to atmospheric pressure, a meniscus formation step (Step S7) is next performed which forms ink menisci in the nozzles 212 of the first head 21 and the second head 22.

Figure 12:
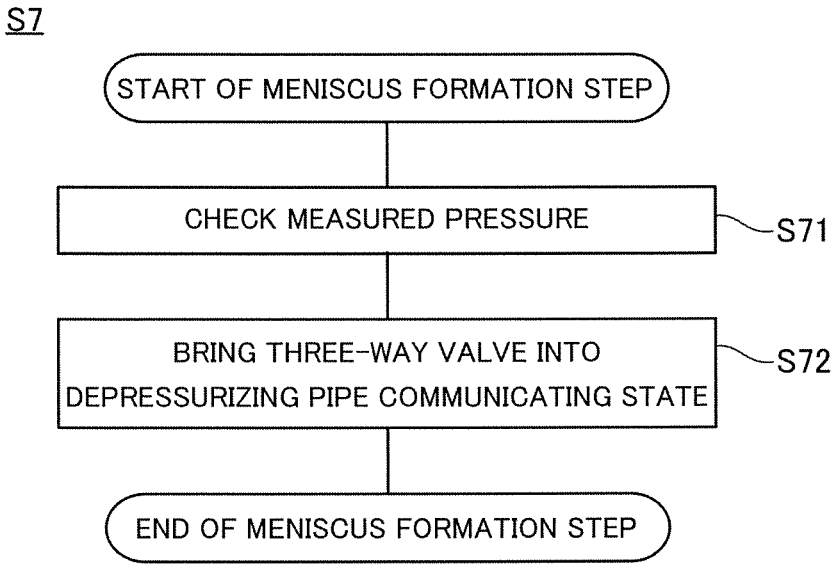
FIG. 12 is a flow diagram showing a meniscus formation step according to the first preferred embodiment.
Figure 13:
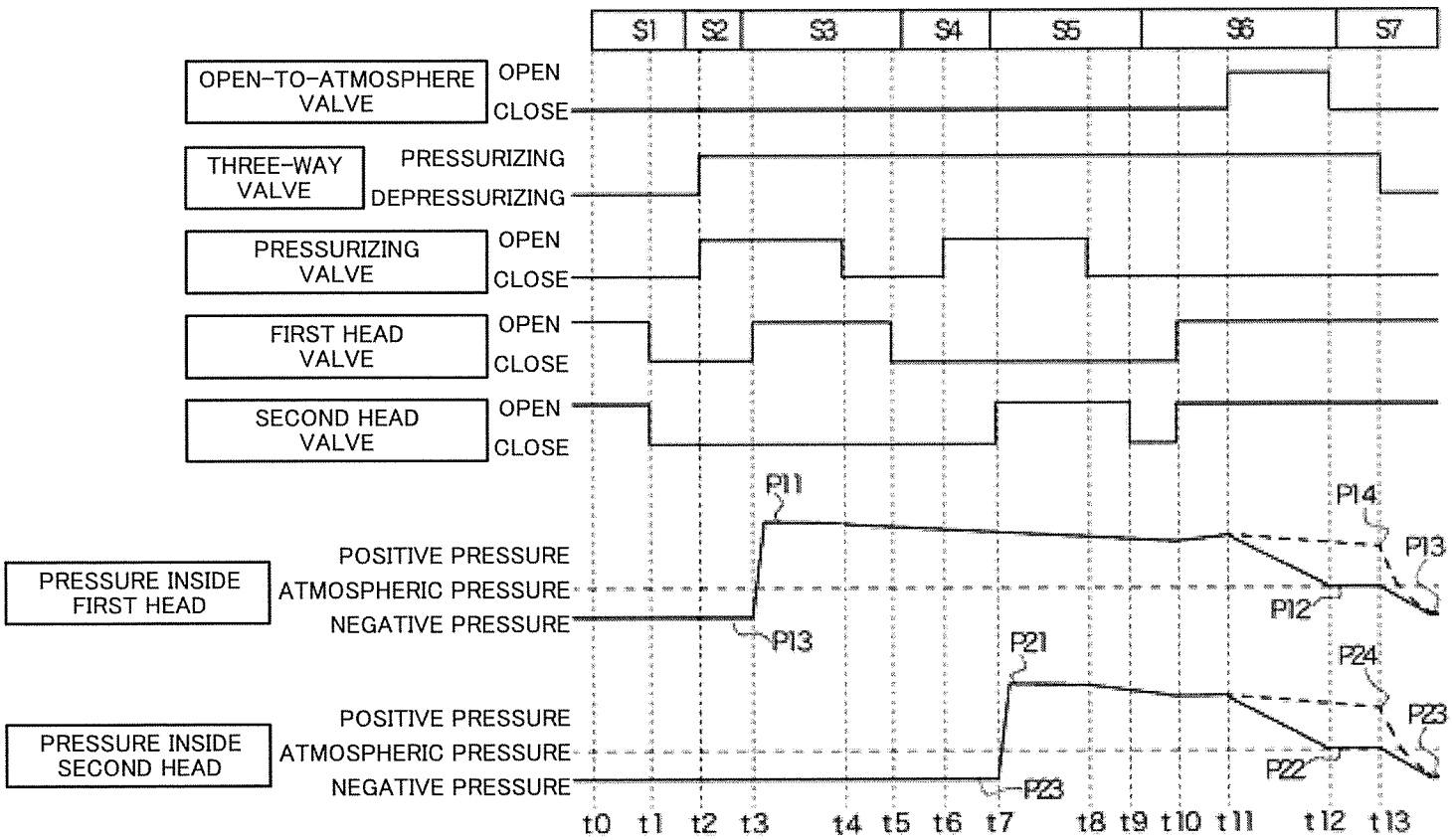
FIG. 13 is a timing diagram of the recovery step according to the first preferred embodiment.

FIG. 12 is a flow diagram showing the details of the meniscus formation step. Upon starting the meniscus formation step, the controller 8 initially checks whether the pressure of the gas in the depressurizing pipe 362 is maintained at a pressure (referred to hereinafter as a "meniscus pressure") which allows the formation of ink menisci in the nozzles 212 or not, based on a signal from the pressure sensor 366 (Step S71). The controller 8 controls the driving of the depressurizing pump 361 and the opening/closing of the depressurizing valve 363 or the open-to-atmosphere valve 356 to regulate the pressure of the gas in the depressurizing pipe 362 at the meniscus pressure.

Upon checking that the pressure in the depressurizing pipe 362 is maintained at the meniscus pressure in Step S71, the controller 8 provides an operating instruction to bring the three-way valve 332 into the depressurizing pipe communicating state (Step S72). This depressurizes the gas inside the sub-tank 321 through the pressure regulating pipe 331 and the depressurizing pipe 362 to accordingly depressurize the ink inside the sub-tank 321. Thus, after the open-to-atmosphere step in Step S61, the ink inside the first and second heads 21 and 22 in communication with the sub-tank 321 is also depressurized, so that ink menisci are formed in the respective nozzles 212.

The recovery step in the first preferred embodiment is thus completed. The pressures inside the first head 21 and the second head 22 in the recovery step according to the first preferred embodiment will be described with reference to the timing diagram of FIG. 13.

The open/closed positions of the valves are shown in upper part of the timing diagram of FIG. 13, and the pressures inside the heads are schematically shown in the lower part thereof. The reference characters S1 to S7 at the top correspond to Steps S1 to S7 in the flow diagram of the recovery step in FIG. 5, and the reference characters t0 to t13 at the bottom denote points of time. The intervals between the points of time t0 to t13 are shown as exaggerated, as appropriate, for purposes of clarifying the steps, and do not necessarily coincide with the actual intervals between the points of time in the recovery step.

In the upper part of FIG. 13, the open position of each valve is denoted as "OPEN" and the closed position thereof is denoted as "CLOSED". The pressurizing pipe communicating state of the three-way valve 332 is denoted as "PRES- SURIZING" and the depressurizing pipe communicating state thereof is denoted as "DEPRESSURIZING". The lower part of FIG. 13 shows the pressures inside the first head 21 and the second head 22. A positive pressure is shown over atmospheric pressure, and a negative pressure is shown under atmospheric pressure. The inside pressures at the respective points of time will be described later.

The recovery step in the first preferred embodiment will be described with reference to FIGS. 5 and 13, as appropriate. Upon selecting the computer program 831 relating to the recovery process stored in the storage part 83, the controller 8 instructs the components of the liquid ejecting apparatus 1 to perform the recovery process. At the time t0, the initialization step (Step S1) starts.

At the time t1, Step S15 in the initialization step is performed, so that the first head valve 313 and the second head valve 315 are brought into the closed position. At this time, the pressures inside the first head 21 and the second head 22 are held at a state of negative pressure lower than atmospheric pressure for the formation of ink menisci in the nozzles 212, and are a "meniscus pressure P13" and a "meniscus pressure P23", respectively.

At the time t2, Step S21 and Step S22 in the pre-pressurization step are performed substantially simultaneously, so that the pressurizing valve 343 is brought into the open position and the three-way valve 332 is switched from the depressurizing pipe communicating state to the pressurizing pipe communicating state. Thus, the ink inside the sub-tank 321 is pressurized, but the first head 21 and the second head 22 are not pressurized to maintain the meniscus pressures to some extent because the first head valve 313 and the second head valve 315 are in the closed position. After the time t2, the controller 8 monitors whether the sub-tank 321 is pressurized to not less than the first pressure or not, based on the signal from the pressure sensor 346.

The time t3 is a point of time at which the controller 8 judges that the sub-tank 321 is pressurized to not less than the first pressure. At this point of time, Step S31 in the first purge step is performed, so that the first head valve 313 is brought into the open position. This starts the pressurization of the ink inside the first head 21, so that the ink starts being forced out of the nozzles 212. The pressure inside the first head 21 is increased to a pressure P11. The pressure P11 is a "purge pressure" required to force the ink inside the first head 21 out of the nozzles 212 in the first purge step (Step S3), and is a pressure applied to the first head 21 when the sub-tank 321 is pressurized to the first pressure.

In Step S32 in the first purge step, a lapse of a predetermined time period since the time t3 is monitored. The predetermined time period is selected, as appropriate, depending on purge conditions including the amount of ejected ink required for the first head 21 and the like. The time t4 is a point of time at which the controller 8 judges that the predetermined time period has elapsed since the time t3. At this point of time, the pressurizing valve 343 is brought into the closed position (Step S33). Then, the first head valve 313 is brought into the closed position at the time t5 (Step S34).

The time t4 and the time t5 are different points of time in the first preferred embodiment, but are not limited to this for the practice of the present invention. The pressurizing valve 343 and the first head valve 313 may be brought into the closed position substantially simultaneously at the time t4.

At the time t6, the opening of the pressurizing valve 343 in the re-pressurization step (Step S4) is performed. After the time t6, the controller 8 monitors whether the sub-tank 321 is pressurized to not less than the first pressure or not.

The time t7 is a point of time at which the controller 8 judges that the sub-tank 321 is pressurized to not less than the first pressure after the time t6. At this point of time, Step S51 in the second purge step is performed, so that the second head valve 315 is brought into the open position. This starts the pressurization of the ink inside the second head 22, so that the ink starts being forced out of the nozzles 212. The pressure inside the second head 22 is increased to a pressure P21. The pressure P21 is a "purge pressure" required to force the ink inside the second head 22 out of the nozzles 212 in the second purge step (Step S5), and is a pressure applied to the second head 22 when the sub-tank 321 is pressurized to the first pressure.

In Step S52 in the second purge step, a lapse of a predetermined time period since the time t7 is monitored. The predetermined time period is selected, as appropriate, depending on purge conditions including the amount of ejected ink required for the second head 22 and the like. The time t8 is a point of time at which the controller 8 judges that the predetermined time period has elapsed since the time t7. At this point of time, the pressurizing valve 343 is brought into the closed position (Step S53). Then, the second head valve 315 is brought into the closed position at the time t9 (Step S54).

The time t8 and the time t9 are different points of time in the first preferred embodiment, but are not limited to this for the practice of the present invention. The pressurizing valve 343 and the second head valve 315 may be brought into the closed position substantially simultaneously at the time t8.

At the time t10, Step S61 in the open-to-atmosphere step is performed, so that the first head valve 313 and the second head valve 315 are brought into the open position.

The pressures inside the first head 21 and the second head 22 which are caused to reach the pressure P11 and the pressure P21, respectively, by the first purge step and the second purge step decrease gradually after the first purge step and the second purge step as the ink is forced out of the nozzles 212. Thus, after the completion of the second purge step (the time t9), there are cases in which the pressures inside the first head 21 and the second head 22 do not completely return to atmospheric pressure but in a state of positive pressure as shown in FIG. 13.

Also, there are cases in which at the time t10 the pressure of the ink inside the sub-tank 321 is higher than the pressures inside the first head 21 and the second head 22 which decrease as the ink is forced out of the nozzles 212, and the pressures inside the first head 21 and the second head 22 become higher as shown in FIG. 13 after the first head valve 313 and the second head valve 315 are brought into the open position at the time t10.

Subsequently, at the time t11, Step S62 in the open-to-atmosphere step is performed, so that the open-to-atmosphere valve 352 is brought into the open position. Thus, the pressure of the gas by which a positive pressure has been applied to the interior of the sub-tank 321 decreases toward atmospheric pressure, and the pressures of the ink in the sub-tank 321, the first head 21 and the second head 22 decrease toward atmospheric pressure. The rate at which these pressures decrease is higher than the rate at which the pressures decrease as the ink is forced out of the nozzles 212.

This results from the facts that the flow passage resistance of the ink between the first and second heads 21 and 22 and the sub-tank 321 is sufficiently lower than the flow passage resistance of the ink in the nozzles 212 and that the flow passage resistance of the gas pressurizing the sub-tank 321 between the sub-tank 321 and the pressurizing and open-to-atmosphere pipes 342 and 355 is sufficiently lower than the flow passage resistance of the ink.

After the time t11, the controller 8 monitors whether the pressure inside the sub-tank 321 is decreased to not greater than the second pressure or not, based on the signal from the pressure sensor 346 (Step S63). The time t12 is a point of time at which the controller 8 judges that the pressure inside the sub-tank 321 is decreased to not greater than a predetermined value after the time t11. At this point of time, Step S64 in the open-to-atmosphere step is performed, so that the open-to-atmosphere valve 352 is brought into the closed position. The predetermined value is atmospheric pressure in the first preferred embodiment.

At the time t12, the pressures inside the first head 21 and the second head 22 are decreased to a pressure P12 and a pressure P22, respectively. The pressure P12 and the pressure P22 are lower than the pressure P11 and the pressure P21, respectively, and are not less than atmospheric pressure. In the first preferred embodiment both the pressure P12 and the pressure P22 are atmospheric pressure.

Next, at the time t13, Step S72 in the meniscus formation step is performed, so that the three-way valve 332 is switched from the pressurizing pipe communicating state to the depressurizing pipe communicating state. Thus, the pressures inside the first head 21 and the second head 22 are decreased to the meniscus pressures (i.e., the pressure P13 and the pressure P23) at which ink menisci are formed in the nozzles 212.

The time t12 and the time t13 are different points of time in the first preferred embodiment, but are not limited to this for the practice of the present invention. The three-way valve 332 may be switched from the pressurizing pipe communicating state to the depressurizing pipe communicating state substantially simultaneously with the process of bringing the open-to-atmosphere valve 352 into the closed position at the time t12.

The drawing of air bubbles into the nozzles during the formation of ink menisci will be described. If the pressures inside the first head 21 and the second head 22 change by large amounts before and after the execution of Step S72 in the meniscus formation step, the force drawing the ink into the nozzles acts strongly, so that air bubbles are more prone to be drawn into the nozzles 212.

The pressures inside the first head 21 and the second head 22 in the case where the opening of the open-to-atmosphere valve 352 in Step S62 in the open-to-atmosphere step is not performed are indicated by broken lines in FIG. 13. In the case where Step S62 is not performed, the pressures inside the first head 21 and the second head 22 at the time t13 are pressures P14 and P24, respectively. The pressures P14 and P24 are lower than the pressures P11 and P21 and higher than the pressures P12 and P22, respectively. When Step S72 is performed in such a state to switch the three-way valve 332 to the depressurizing pipe communicating state, the pressure inside the first head 21 decreases from the pressure P14 to the pressure P13, so that the amount of change in the pressure inside the first head 21 is expressed as (P14–P13). Also, the pressure inside the second head 22 decreases from the pressure P24 to the pressure P23, so that the amount of change in the pressure inside the second head 22 is expressed as (P24–P23).

On the other hand, the amounts of change in the pressures inside the first head 21 and second head 22 before and after the execution of Step S72 are expressed as (P12–P13) and (P22–P23), respectively, in the case where the first head valve 313 and the second head valve 315 are brought into the open position in the open-to-atmosphere step and the opening of the open-to-atmosphere valve 352 is performed in Step S62. The amounts of change in the pressures are smaller by the amounts corresponding to the decrease in the pressures inside the first head 21 and the second head 22 in Step S62. Thus, the force drawing the ink into the nozzles 212 in this case is weaker than that in the case where the open-to-atmosphere step is not performed, so that air bubbles are less prone to be drawn into the nozzles 212.

In the first preferred embodiment, the first purge step (Step S3) is performed after the pre-pressurization step (Step S2) is performed, and thereafter the re-pressurization step (Step S4) is performed, following which the second purge step (Step S5) is performed. In the first purge step, a first open/close part is brought into the open position to start forcing the ink from the first head 21. This varies the pressure of the ink inside the sub-tank 321 from an initial state. In the first preferred embodiment, the subsequent execution of the re-pressurization step (Step S4) allows the pressure of the ink inside the sub-tank 321 prior to the execution of the second purge step to return to the state prior to the first purge step or to be brought into a state preferable for the second purge step. As a result, this provides equal purge conditions in the second purge step and in the aforementioned first purge step (Step S3).

Further, the pressurized purge of the first head 21 and the pressurized purge of the second head 22 are executed separately in the first preferred embodiment. As compared with the simultaneous execution of the pressurized purges of the first head 21 and the second head 22, the separate execution thereof suppresses a difference between the rate at which the ink supplied from the sub-tank 321 flows to the first head 21 and the rate at which the ink supplied from the sub-tank 321 flows to the second head 22 to provide more equal purge conditions. This reduces a difference between the amount of ink forced from the first head 21 during the execution of the first purge step and the amount of ink forced from the second head 22 during the execution of the second purge step to suppress unevenness in density during image recording and excess ink consumption in the first and second purge steps.

2. Second Preferred Embodiment

Next, a second preferred embodiment according to the present invention will be described. As described above, the purge conditions for the first head 21 and the second head 22 are adjusted in the first preferred embodiment by providing the pre-pressurization step prior to the execution of the first purge step and providing the re-pressurization step prior to the execution of the second purge step. These steps are not limited to this for the practice of the present invention. For example, the re-pressurization step (Step S4) prior to the execution of the second purge step may be dispensed with in the case where there is a small variation in the pressure of ink inside the sub-tank 321 after the first purge step.

The second preferred embodiment is a preferred embodiment in which the recovery step in the first preferred embodiment is more simplified. The liquid ejecting apparatus 1 according to the second preferred embodiment is similar to the liquid ejecting apparatus 1 according to the first preferred embodiment shown in FIGS. 1 to 4, and will not be described. The second preferred embodiment differs from the first preferred embodiment in that the step corresponding to the re-pressurization step (Step S4) of the first preferred embodiment is not performed in the recovery step and in that the first purge step and the second purge step are more simplified. Other steps similar to those of the first preferred embodiment will not be described, as appropriate.

Figure 14:
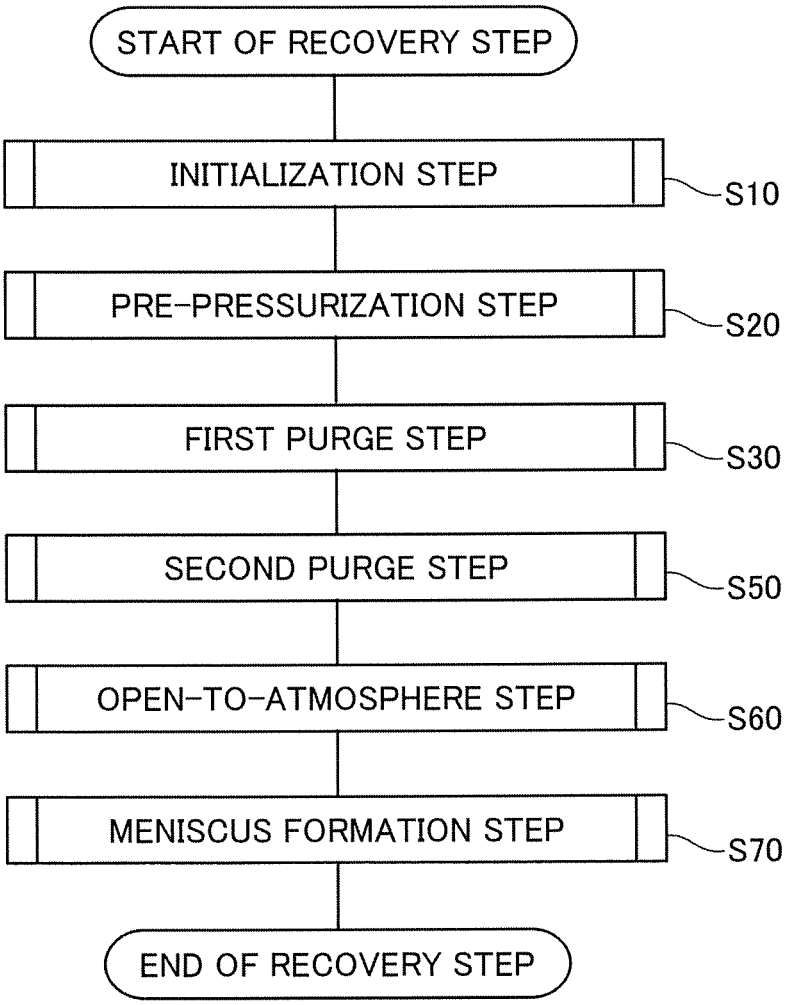
FIG. 14 is a flow diagram showing the recovery step according to a second preferred embodiment of the present invention.
Figure 15:
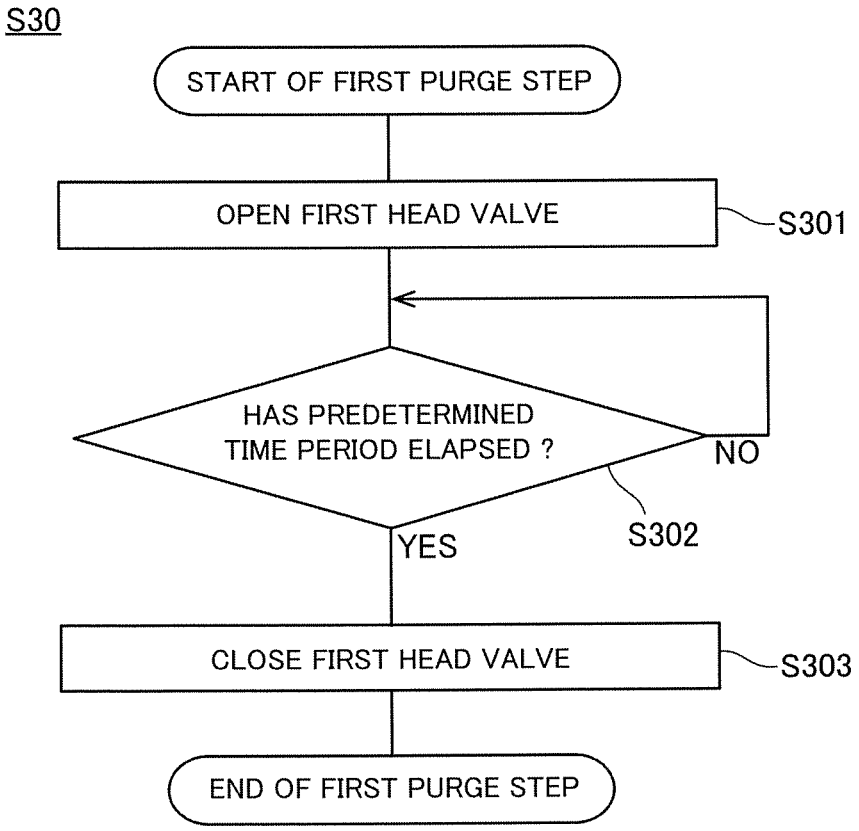
FIG. 15 is a flow diagram showing the first purge step according to the second preferred embodiment.
Figure 16:
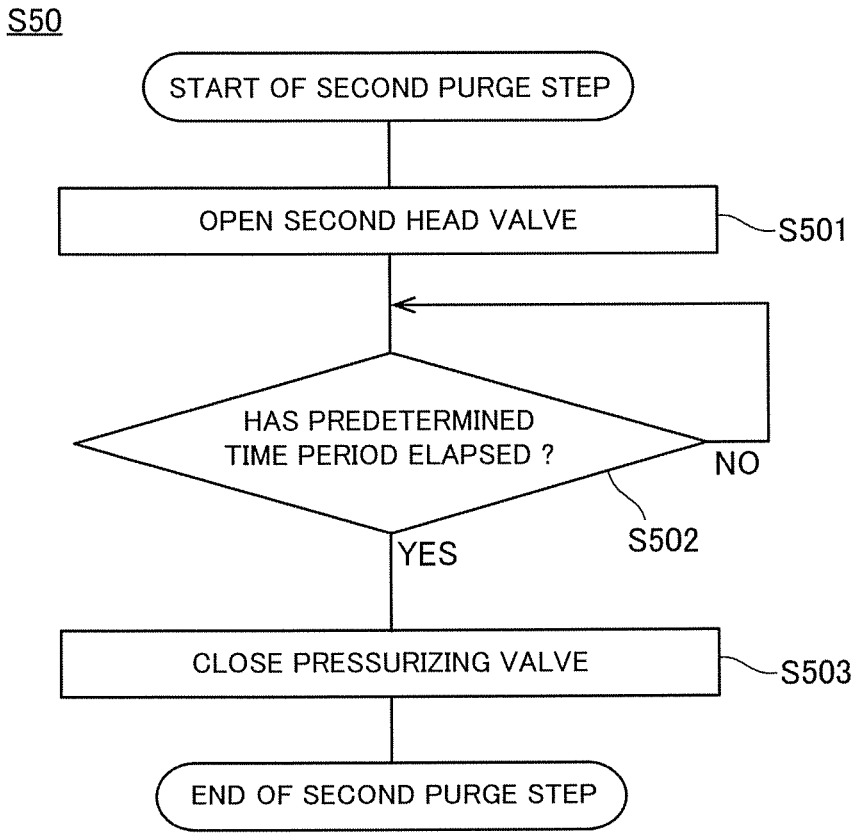
FIG. 16 is a flow diagram showing the second purge step according to the second preferred embodiment.

FIG. 14 is a flow diagram showing the recovery step according to the second preferred embodiment. When the controller 8 provides the recovery operation instruction to the liquid ejecting apparatus 1, the liquid ejecting apparatus 1 according to the second preferred embodiment performs the recovery step shown in FIG. 14. FIG. 15 is a flow diagram showing the first purge step according to the second preferred embodiment. FIG. 16 is a flow diagram showing the second purge step according to the second preferred embodiment.

Upon starting the recovery step in the second preferred embodiment, the controller 8 provides an operating instruction, so that the liquid ejecting apparatus 1 performs the initialization step (Step S10) and the pre-pressurization step (Step S20). In the initialization step (Step S10), the liquid ejecting apparatus 1 performs steps similar to those of the initialization step (Step S1) of the first preferred embodiment. In the pre-pressurization step (Step S20), the liquid ejecting apparatus 1 performs steps similar to those of the pre-pressurization step (Step S2) of the first preferred embodiment. After the pre-pressurization step (Step S20) is completed, the controller 8 next provides an operating instruction to start the first purge step (Step S30).

FIG. 15 is a flow diagram showing the details of the first purge step. Upon starting the first purge step, the controller 8 initially provides an operating instruction to bring the first head valve 313 into the open position (Step S301). This causes the supply pipe 311 and the sub-tank 321 which are brought into the state of positive pressure by the pre-pressurization step (Step S20) to communicate with the first head 21. Thus, the ink inside the first head 21 is brought into the state of positive pressure, so that the ink is forced out of the nozzles 212 of the first head 21. That is, the opening of the first head valve 313 starts the pressurized purge in the first head 21.

Forcing the ink out of the nozzles 212 of the first head 21 in the aforementioned manner eliminates the problems of the increased viscosity and solidification of ink in the nozzles 212 of the first head 21. Also, when the ink contains a precipitable ingredient, this eliminates the problem of the precipitation of the ink inside the first head 21.

After the first head valve 313 is brought into the open position, the timer not shown measures the amount of time elapsed since the first head valve 313 was brought into the open position. The value measured by the timer is inputted as a signal to the controller 8. The controller 8 judges whether a predetermined time period has elapsed since the first head valve 313 was brought into the open position or not (Step S302). When the controller 8 judges in Step S302 that the predetermined time period has elapsed (i.e., the answer to Step S302 is YES), the first head valve 313 is brought into the closed position (Step S303). This completes the first purge step (Step S30). The second preferred embodiment differs from the first preferred embodiment in that the pressurizing valve 343 is maintained in the open position after the completion of the first purge step.

When the first head valve 313 is closed by the controller 8 in Step S303, the ink inside the first head 21 and the ink inside the supply pipe 311 are isolated from each other, so that the ink inside the sub-tank 321 and inside the supply pipe 311 stops pressurizing the ink inside the first head 21. After the pressurization stops, the ink inside the first head 21 continues to be ejected from the nozzles 212 of the first head 21. Thus, the pressure of the ink inside the first head 21 decreases gradually from the state of positive pressure toward atmospheric pressure.

Referring again to FIG. 14, after the first purge step is completed, the liquid ejecting apparatus 1 performs the second purge step (Step S50) which brings the second head valve 315 into the open position to force ink out of the nozzles 212 of the second head 22.

FIG. 16 is a flow diagram showing the details of the second purge step. Upon starting the second purge step, the controller 8 initially provides an operating instruction to bring the second head valve 315 into the open position (Step S501) after a predetermined time period has elapsed since the operating instruction was provided.

The supply pipe 311 and the sub-tank 321 are also maintained in the state of positive pressure because the pressurizing valve 343 is maintained in the open position after the completion of the first purge step as described above. When the second head valve 315 is brought into the open position to cause the sub-tank 321 and the second head 22 to communicate with each other in such a state, the ink inside the second head 22 is brought into the state of positive pressure, so that the ink is forced out of the nozzles 212 of the second head 22. That is, the opening of the second head valve 315 starts the pressurized purge in the second head 22.

By bringing the second head valve 315 into the open position in Step S501 after the predetermined time period has elapsed since the operating instruction was provided, the processes of forcing the ink out of the nozzles 212 of the first head 21 and the second head 22 are performed independently in terms of time with reliability. Further, this allows the pressure of the ink inside the sub-tank 321 prior to the execution of the second purge step to return to the state prior to the first purge step again during the predetermined time period.

Forcing the ink out of the nozzles 212 of the second head 22 in the aforementioned manner eliminates the problems of the increased viscosity and solidification of ink in the nozzles 212 of the second head 22. Also, when the ink contains a precipitable ingredient, this eliminates the problem of the precipitation of the ink inside the second head 22.

After the second head valve 315 is brought into the open position, the timer not shown measures the amount of time elapsed since the second head valve 315 was brought into the open position. The value measured by the timer is inputted as a signal to the controller 8. The controller 8 judges whether a predetermined time period has elapsed since the second head valve 315 was brought into the open position or not (Step S502). When the controller 8 judges in Step S502 that the predetermined time period has elapsed (i.e., the answer to Step S502 is YES), the pressurizing valve 343 is brought into the closed position (Step S503). This completes the second purge step (Step S50).

In the second purge step according to the second preferred embodiment, the second head valve 315 is not brought into the closed position after Step S501 is performed to force the ink from the second head 22. When the pressurizing valve 343 is closed by the controller 8 in Step S503, the communication the pressurizing pump 341 and the sub-tank 321 is closed off, so that the pressurization of the ink in the sub-tank 321 stops. After the pressurization stops, the ink inside the second head 22 continues to be ejected from the nozzles 212 of the second head 22. Thus, the pressure of the ink inside the second head 22 decreases gradually from the state of positive pressure toward atmospheric pressure.

Referring again to FIG. 14, after the second purge step (Step S50) is completed whereby the pressurized purges of the first head 21 and the second head 22 in each head unit 2 are completed, an open-to-atmosphere step (Step S60) is next performed which reduces the pressure of the ink inside the first head 21 and the second head 22. In the open-to-atmosphere step (Step S60), the liquid ejecting apparatus 1 performs steps substantially similar to those of the open-to-atmosphere step (Step S6) of the first preferred embodiment.

In Step S61 in the open-to-atmosphere step of the first preferred embodiment, both the first head valve 313 and the second head valve 315 are switched from the closed position to the open position. However, the second head valve 315 is already in the open position when the open-to-atmosphere step of the second preferred embodiment is performed. Thus, in the step corresponding to Step S61 in the second preferred embodiment, the first head valve 313 is switched from the closed position to the open position, and the second head valve 315 is maintained in the open position. The open-to-atmosphere step (Step S60) of the second preferred embodiment differs in such a point from the open-to-atmosphere step (Step S6) of the first preferred embodiment. The remaining steps in the open-to-atmosphere step (Step S60) are performed similarly as in the first preferred embodiment.

After the open-to-atmosphere step (Step S60) is performed, the meniscus formation step (Step S70) is performed. In the meniscus formation step (Step S70), the liquid ejecting apparatus 1 performs steps similar to those of the meniscus formation step (Step S7) of the first preferred embodiment.

The recovery step of the liquid ejecting apparatus 1 in the second preferred embodiment is thus completed. The pressures inside the first head 21 and the second head 22 in the recovery step according to the second preferred embodiment will be described with reference to the flow diagram of FIG. 14 and the timing diagram of FIG. 17, as appropriate. The open/closed positions of the valves and the pressures inside the heads are schematically denoted in FIG. 17 in the same manner as in the timing diagram of FIG. 13.

Upon selecting the computer program 831 relating to the recovery process stored in the storage part 83, the controller 8 instructs the components of the liquid ejecting apparatus 1 to perform the recovery process. At the time t0, the initialization step (Step S10) starts.

The steps from the time t0 to the time t3 are similar to those of the first preferred embodiment, and will not be described. The time t3 is a point of time at which the controller 8 judges that the sub-tank 321 is pressurized to not less than the first pressure. At this point of time, Step S301 in the first purge step is performed, so that the first head valve 313 is brought into the open position. This starts the pressurization of the ink inside the first head 21, so that the ink starts being forced out of the nozzles 212. The pressure inside the first head 21 is increased to the pressure P11. The pressure P11 is a "purge pressure" required to force the ink inside the first head 21 out of the nozzles 212 in the first purge step (Step S30), and is a pressure applied to the first head 21 when the sub-tank 321 is pressurized to the first pressure.

In Step S302 in the first purge step, a lapse of a predetermined time period since the time t3 is monitored. The predetermined time period is selected, as appropriate, depending on purge conditions including the amount of ejected ink required for the first head 21 and the like. The time t5 is a point of time at which the controller 8 judges that the predetermined time period has elapsed since the time t3. At this point of time, the first head valve 313 is brought into the closed position (Step S303).

The time t7 is a point of time after a predetermined time period has elapsed since the time t5. During this predetermined time period, the pressure of the ink inside the sub-tank 321 which is decreased from the pre-pressurization step when the first purge step is performed is increased up to a predetermined pressure (the "first pressure" in this preferred embodiment) by the pressurization of the pressurizing pump 341. At the time t7, Step S501 in the second purge step is performed, so that the second head valve 315 is brought into the open position. This starts the pressurization of the ink inside the second head 22, so that the ink starts being forced out of the nozzles 212. The pressure inside the second head 22 is increased to the pressure P21. The pressure P21 is a "purge pressure" required to force the ink inside the second head 22 out of the nozzles 212 in the second purge step (Step S50), and is a pressure applied to the second head 22 when the sub-tank 321 is pressurized to the first pressure.

In Step S502 in the second purge step, a lapse of a predetermined time period since the time t7 is monitored. The predetermined time period is selected, as appropriate, depending on purge conditions including the amount of ejected ink required for the second head 22 and the like. The time t8 is a point of time at which the controller 8 judges that the predetermined time period has elapsed since the time t7. At this point of time, the pressurizing valve 343 is brought into the closed position (Step S503). At the time t8, the first head valve 313 is in the closed position, and the second head valve 315 is in the open position.

Figure 17:
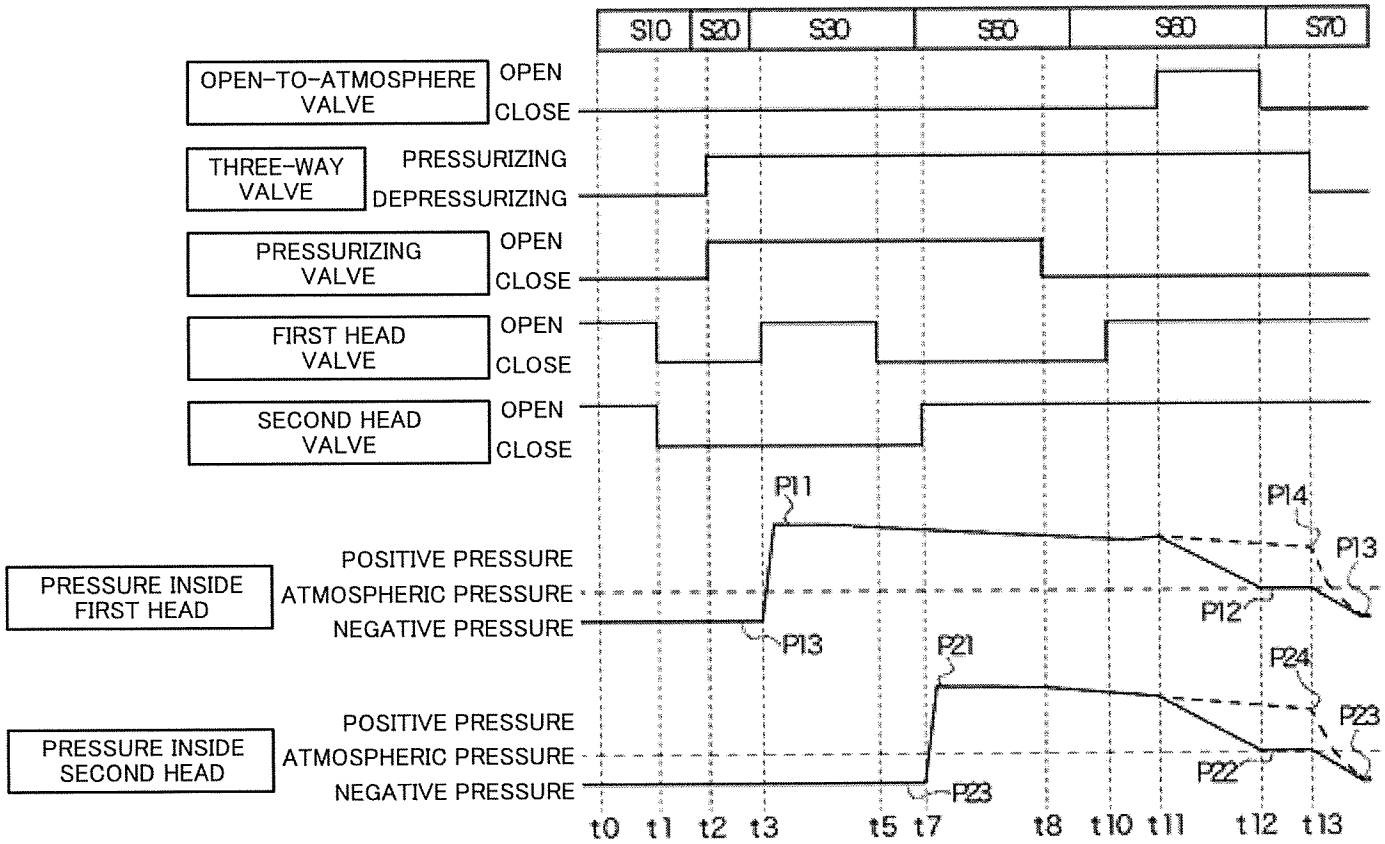
FIG. 17 is a timing diagram of the recovery step according to the second preferred embodiment.

At the time t10, Step S61 in the open-to-atmosphere step is performed, so that the first head valve 313 is switched from the closed position to the open position, whereas the second head valve 315 is maintained in the open position. The pressures inside the first head 21 and the second head 22 which are caused to reach the pressure P11 and the pressure P21, respectively, by the first purge step and the second purge step decrease gradually after the first purge step and the second purge step as the ink is forced out of the nozzles 212. Thus, after the completion of the second purge step (the time t8), there are cases in which the pressures inside the first head 21 and the second head 22 do not completely return to atmospheric pressure but in a state of positive pressure as shown in FIG. 17.

Subsequently, the steps from the time t11 to the time t13 are performed in the same manner as in FIG. 12 of the first preferred embodiment. Specifically, at the time t11, the open-to-atmosphere valve 352 is brought into the open position, so that the pressures of the ink inside the first head 21 and the second head 22 decrease toward atmospheric pressure. Then, at the time t12, the open-to-atmosphere valve 352 is brought into the closed position. Next, at the time t13, the three-way valve 332 is switched from the pressurizing pipe communicating state to the depressurizing pipe communicating state. Thus, the pressures inside the first head 21 and the second head 22 are decreased to the meniscus pressures (i.e., the pressure P13 and the pressure P23) at which ink menisci are formed in the nozzles 212.

In the liquid ejecting apparatus 1 according to the second preferred embodiment as described above, the execution of the open-to-atmosphere step (Step S60) makes the force drawing the ink into the nozzles 212 weaker than that in the case where the open-to-atmosphere step is not performed, so that air bubbles are less prone to be drawn into the nozzles 212.

In the second preferred embodiment, the first purge step (Step S30) is performed after the pre-pressurization step (Step S20) is performed, and thereafter the second head valve 315 is brought into the open position (Step S501) after a lapse of the predetermined time period in the second purge step (Step S50). In the first purge step, the first open/close part is brought into the open position to start forcing the ink from the first head 21. This varies the pressure of the ink inside the sub-tank 321 from an initial state. In the second preferred embodiment, the provision of the predetermined delay time period after the operating instruction from the controller 8 in Step S501 allows the pressure of the ink inside the sub-tank 321 prior to the execution of the second purge step to return again to the state prior to the first purge step. As a result, this provides equal purge conditions in the second purge step and in the aforementioned first purge step (Step S30).

Further, the pressurized purge of the first head 21 and the pressurized purge of the second head 22 are executed separately in the second preferred embodiment. As compared with the simultaneous execution of the pressurized purges of the first head 21 and the second head 22, the separate execution thereof suppresses a difference between the rate at which the ink supplied from the sub-tank 321 flows to the first head 21 and the rate at which the ink supplied from the sub-tank 321 flows to the second head 22 to provide more equal purge conditions. This reduces a difference between the amount of ink forced from the first head 21 during the execution of the first purge step and the amount of ink forced from the second head 22 during the execution of the second purge step to suppress unevenness in density during image recording and excess ink consumption in the first and second purge steps.

Furthermore, the number of times of switching between the open and closed positions of the valves in the second preferred embodiment is less than that in the first preferred embodiment. This shortens the time required for the switching of the valves to allow the recovery process to be performed using more simplified steps.

3. Third Preferred Embodiment

Next, a third preferred embodiment according to the present invention will be described. The configuration of the ink supply system 3 is not limited to that shown in FIG. 4 in the first and second preferred embodiments for the practice of the present invention, but may be a configuration as shown in FIG. 18 for use in the third preferred embodiment.

The third preferred embodiment is a preferred embodiment in which the supply system 3 of the first preferred embodiment is partially changed. Specifically, the number of heads is increased by one, so that each of the head units 2 includes three heads. A third head 23 newly added is a head which is not subjected to a purge in the recovery step. The external appearance of the liquid ejecting apparatus 1 according to the third preferred embodiment is substantially similar to that of the liquid ejecting apparatus 1 according to the first preferred embodiment shown in FIGS. 1 to 3, and will not be described. Also, the recovery step according to the third preferred embodiment is substantially similar to the recovery step according to the second preferred embodiment. Steps similar to those in the recovery step of the second preferred embodiment will not be described, as appropriate.

<3-1. Supply System>

Figure 18:
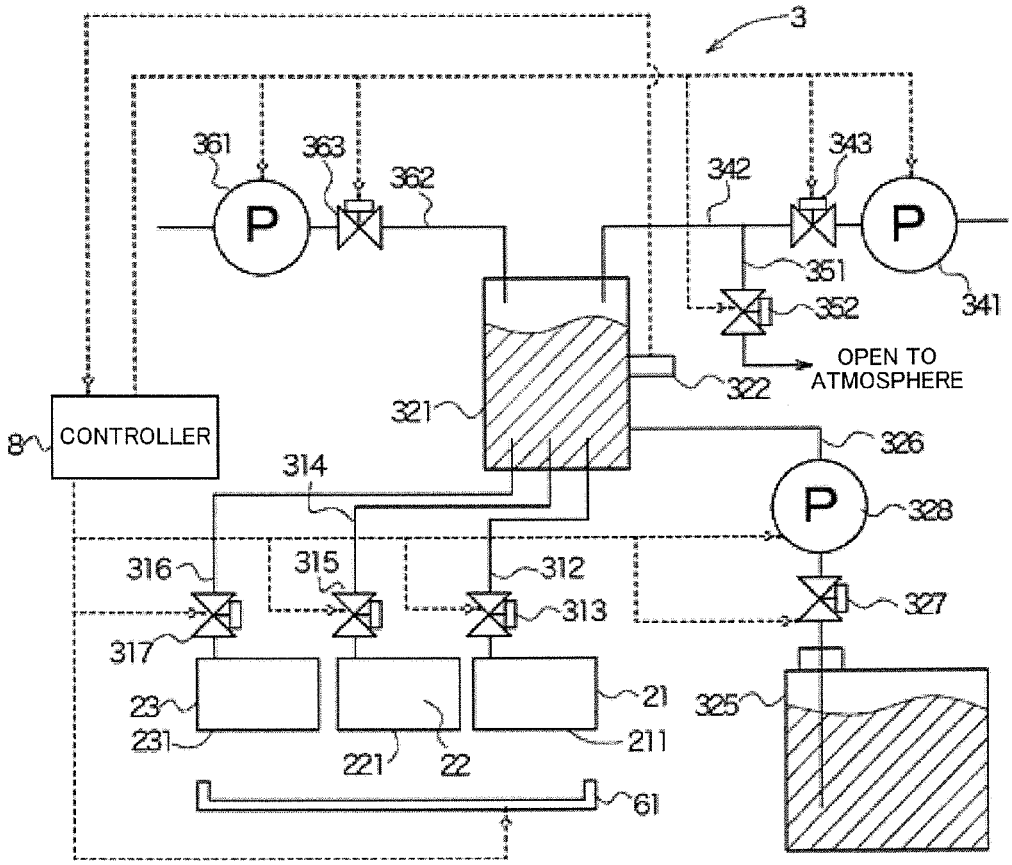
FIG. 18 is a block diagram showing the ink supply system according to a third preferred embodiment of the present invention.

FIG. 18 is a block diagram schematically showing the supply system 3 according to the third preferred embodiment. In FIG. 18, parts similar to those of the first preferred embodiment are designated by like reference numerals and characters, and will not be described, as appropriate. Differences from the first preferred embodiment will be described.

The supply system 3 of the third preferred embodiment differs from that of the first preferred embodiment in that the supply pipe 311 for causing the sub-tank 321 to communicate with the first branch pipe 312 and the second branch pipe 314 is not provided but the first branch pipe 312 and the second branch pipe 314 communicate directly with the sub-tank 321.

Each of the head units 2 in the third preferred embodiment further includes the third head 23 having a nozzle surface 231 including nozzles 212. The interior of the third head 23 is similar in configuration to that of the first head 21.

The supply system 3 further includes a third branch pipe 316 for providing direct communication between the third head 23 and the sub-tank 321, and a third head valve 317 interposed in the third branch pipe 316 and switchable between an open position which ensures the communication between the sub-tank 321 and the third head 23 and a closed position which closes off the communication between the sub-tank 321 and the third head 23. A known valve may be used as the third head valve 317. The third head valve 317 is electrically connected to the controller 8. The third head valve 317 is switched between the open position and the closed position in response to an operating instruction from the controller 8.

The supply system 3 of the third preferred embodiment further differs from that of the first preferred embodiment in that the three-way valve 332 for providing communication between the sub-tank 321, the pressurizing pipe 342 and the depressurizing pipe 362, and the pressure regulating pipe 331 are not provided, but the pressurizing pipe 342 and the depressurizing pipe 362 communicate directly with the sub-tank 321.

Further, the pressure sensor 346 and the pressure sensor 366 are not provided in the supply system 3 of the third preferred embodiment. Thus, the controller 8 monitors the driving situations (e.g., a driving voltage and the amount of time elapsed since the driving started) of the pressurizing pump 341 and the depressurizing pump 361, the opening/closing situations (e.g., the amount of time elapsed since the switching was done between the open and closed positions) of the valves and the like to thereby estimate the pressure of the ink inside the sub-tank 321.

<3-2. Recovery Step>

Figure 19:
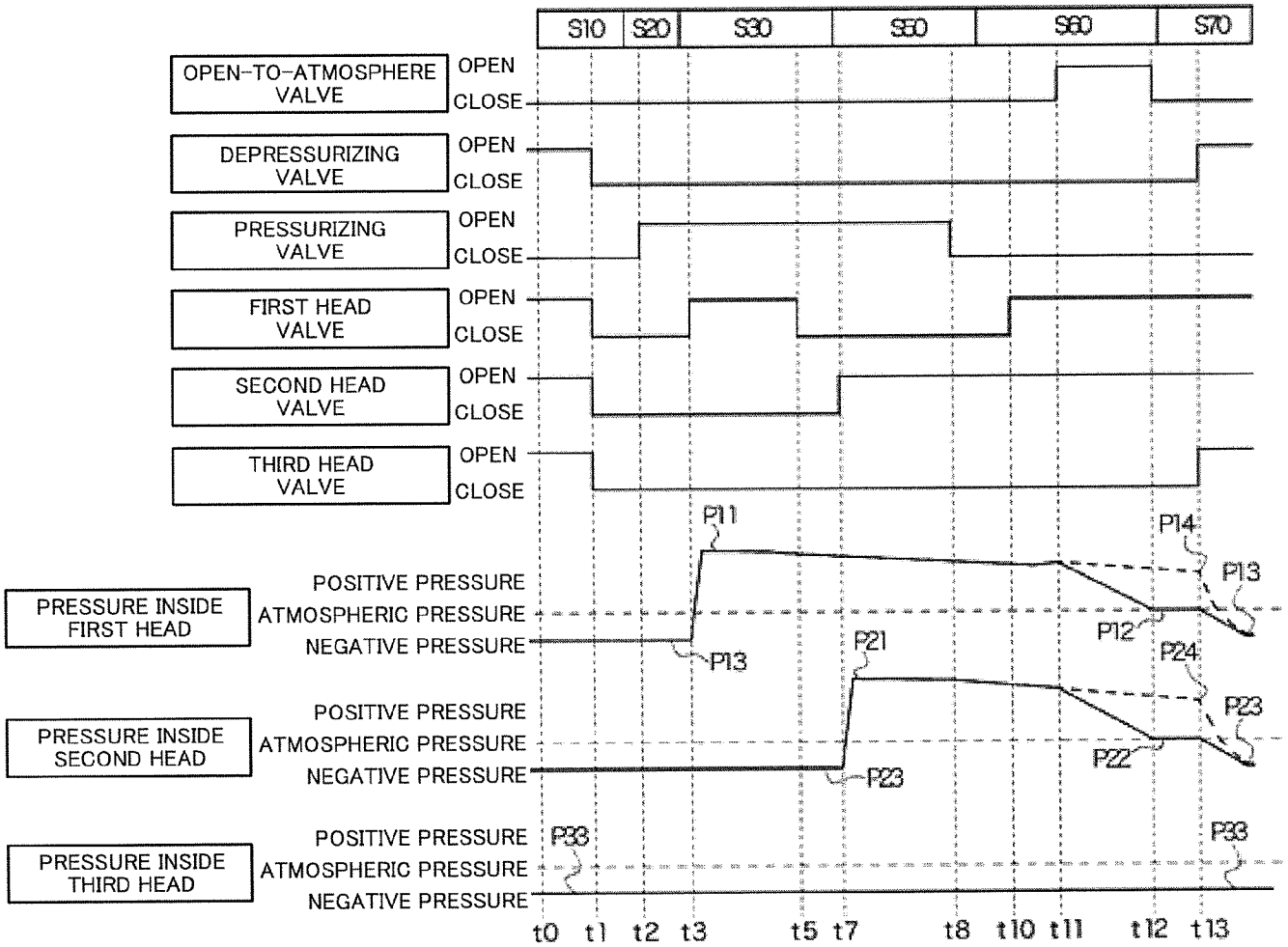
FIG. 19 is a timing diagram of the recovery step according to the third preferred embodiment.

Next, the recovery step according to the third preferred embodiment will be described with reference to FIG. 19. FIG. 19 is a timing diagram of the recovery step according to the third preferred embodiment. The open/closed positions of the valves and the pressures inside the heads are schematically denoted in FIG. 19 in the same manner as in the timing diagram of FIG. 13. The flow diagram of the recovery step according to the third preferred embodiment is substantially similar to that of the recovery step according to the second preferred embodiment shown in FIG. 14 except the control of the third head valve 317. Steps similar to those in the recovery step of the second preferred embodiment will not be described, as appropriate.

Upon selecting the computer program 831 relating to the recovery process stored in the storage part 83, the controller 8 initially instructs the components of the liquid ejecting apparatus 1 to perform the recovery process. At the time t0, the initialization step (Step S10) starts. The initialization step maintains the first head valve 313, the second head valve 315, the third head valve 317 and the depressurizing valve 363 in the open position, and maintains the pressurizing valve 343 in the closed position. Also, the driving of the pressurizing pump 341 starts.

Next, at the time t1, the first head valve 313, the second head valve 315 and the third head valve 317 are brought into the closed position. Further, the depressurizing valve 363 is brought into the closed position, so that the depressurization of the ink inside the sub-tank 321 by the depressurizing pump 361 is stopped. At this time, the pressures inside the first head 21, the second head 22 and the third head 23 are held at a state of negative pressure lower than atmospheric pressure for the formation of ink menisci in the nozzles 212, and are the "meniscus pressure P13", the "meniscus pressure P23" and a "meniscus pressure P33", respectively.

At the time t2, the pressurizing valve 343 is brought into the open position. Thus, the ink inside the sub-tank 321 is pressurized, but the first head 21, the second head 22 and the third head 23 are not pressurized to maintain the meniscus pressures to some extent because the first head valve 313, the second head valve 315 and the third head valve 317 are in the closed position. After the time t2, the controller 8 monitors whether the sub-tank 321 is pressurized to not less than the first pressure or not, based on the amount of time elapsed since the pressurizing valve 343 was brought into the open position.

The time t3 is a point of time at which the controller 8 judges that the sub-tank 321 is pressurized to not less than the first pressure. At this point of time, Step S301 in the first purge step is performed, so that the first head valve 313 is brought into the open position. This starts the pressurization of the ink inside the first head 21, so that the ink starts being forced out of the nozzles 212. The pressure inside the first head 21 is increased to the pressure P11. The pressure P11 is a "purge pressure" required to force the ink inside the first head 21 out of the nozzles 212 in the first purge step (Step S30), and is a pressure applied to the first head 21 when the sub-tank 321 is pressurized to the first pressure. Subsequently, the steps from the time t3 to the time t11 are performed in the same manner as in FIG. 16 of the second preferred embodiment. The third head valve 317 is maintained in the closed position in the steps from the time t3 to the time t11.

At the time t11, the open-to-atmosphere valve 352 is brought into the open position, so that the pressures of the ink inside the first head 21 and the second head 22 decrease toward atmospheric pressure. The controller 8 monitors the amount of time elapsed since the open-to-atmosphere valve 352 was brought into the open position to thereby judge whether the pressure of the ink inside the sub-tank 321 reaches not greater than a predetermined value or not. The predetermined value is atmospheric pressure in the third preferred embodiment.

When the controller 8 judges that the pressure of the ink inside the sub-tank 321 reaches not greater than atmospheric pressure because of a lapse of a predetermined time period since the time t11, the open-to-atmosphere valve 352 is brought into the closed position at the time t12. Next, the third head valve 317 and the depressurizing valve 363 are brought into the open position at the time t13. Thus, the pressures inside the first head 21, the second head 22 and the third head 23 are decreased to the meniscus pressures (i.e., the pressure P13, the pressure P23 and the pressure P33) at which ink menisci are formed in the nozzles 212.

In the liquid ejecting apparatus 1 according to the third preferred embodiment as described above, the execution of the open-to-atmosphere step (Step S60) makes the force drawing the ink into the nozzles 212 weaker than that in the case where the open-to-atmosphere step is not performed, so that air bubbles are less prone to be drawn into the nozzles 212.

In the third preferred embodiment, the first purge step (Step S30) is performed after the pre-pressurization step (Step S20) is performed, and thereafter the second head valve 315 is brought into the open position (Step S501) after a lapse of the predetermined time period in the second purge step (Step S50). In the first purge step, the first open/close part is brought into the open position to start forcing the ink from the first head 21. This varies the pressure of the ink inside the sub-tank 321 from an initial state. In the third preferred embodiment, the provision of the predetermined delay time period after the operating instruction from the controller 8 in Step S501 allows the pressure of the ink inside the sub-tank 321 prior to the execution of the second purge step to return again to the state prior to the first purge step. As a result, this provides equal purge conditions in the second purge step and in the aforementioned first purge step (Step S30).

Further, the pressurized purge of the first head 21 and the pressurized purge of the second head 22 are executed separately in the third preferred embodiment. As compared with the simultaneous execution of the pressurized purges of the first head 21 and the second head 22, the separate execution thereof suppresses a difference between the rate at which the ink supplied from the sub-tank 321 flows to the first head 21 and the rate at which the ink supplied from the sub-tank 321 flows to the second head 22 to provide more equal purge conditions. This reduces a difference between the amount of ink forced from the first head 21 during the execution of the first purge step and the amount of ink forced from the second head 22 during the execution of the second purge step to suppress unevenness in density during image recording and excess ink consumption in the first and second purge steps.

Further, the third preferred embodiment further includes the third head 23, unlike the first and second preferred embodiments. The third head 23 is shorter in the amount of time elapsed since the previous image recording than the first head 21 and the second head 22, and does not require the recovery operation using the pressurized purge. The third preferred embodiment sequentially performs the pressurized purges upon the first head 21 and the second head 22 among the three heads, and does not perform the pressurized purge on the third head 23. This allows the selective purge of the heads which require the pressurized purge. The execution of no purge on the head which does not require the purge reduces the amount of ink consumption in the recovery operation.

The three-way valve 332, the pressure sensor 346 and the pressure sensor 366 are not provided in the third preferred embodiment, unlike the first and second preferred embodiments. Thus, the liquid ejecting apparatus 1 according to the third preferred embodiment includes a smaller number of components. This allows the recovery process to be performed using a more simplified configuration.

4. Modifications

While the main preferred embodiments according to the present invention have been described hereinabove, the present invention is not limited to the aforementioned preferred embodiments.

In the third preferred embodiment are configured so that only the first and second heads are subjected to the purge, but the purge is not performed on the third head. These heads are not limited to this for the practice of the present invention. For example, the first, second and third heads may be configured so that only the first head is subjected to the purge, but the purge is not performed on the second and third heads.

The aforementioned configuration allows the purge to be selectively performed on a head in which, for example, an ejection failure occurs, whereas the purge is not performed on a head which does not require the purge. This reduces the amount of ink forced out of the nozzles in the recovery step.

The configuration of the details of the liquid ejecting apparatus may differ from that shown in the figures of the present invention. The components described in the aforementioned preferred embodiments and in the modifications may be combined together, as appropriate, without inconsistencies.

While the invention has been described in detail, the foregoing description is in all aspects illustrative and not restrictive. It is understood that numerous other modifications and variations can be devised without departing from the scope of the invention.

What is claimed is:

1. A method of controlling a liquid ejecting apparatus for a recovery operation of a head unit, said liquid ejecting apparatus including said head unit having a plurality of heads each including a plurality of nozzles for ejecting a liquid, a liquid reservoir for temporarily storing the liquid for supply to said head unit, a plurality of supply passages for supplying the liquid from said liquid reservoir therethrough to said respective heads, and a plurality of open/close parts provided in said respective supply passages, said open/close parts being switchable between an open position independently ensuring the communication between said liquid reservoir and said heads and a closed position independently closing off the communication between said liquid reservoir and said heads, said method comprising the steps of:

a) pressurizing the liquid inside said liquid reservoir to a state of positive pressure higher than atmospheric pressure, while maintaining all of said open/close parts in said closed position, to thereby performing pre-pressurization;

b) bringing a first one of said open/close parts into said open position and bringing all other ones of said open/close parts into said closed position to perform a first purge, said step b) being performed after said step a);

d) bringing a second one of the open/close parts except said first open/close part brought into said open position in said step b) into said open position and bringing all other ones of said open/close parts into said closed position to perform a second purge, said step d) being performed after said step b); and c) making said liquid reservoir open to the atmosphere, said step c) being performed after said step b) and step d), said step b) being the step of bringing said first open/close part into said open position, and then bringing said first open/close part into said closed position after a predetermined time period has elapsed since said first open/close part was brought into said open position, said step c) being the step of maintaining said open position of said first and second open/close parts brought into said open position in said steps b) and d) when already in said open position, and bringing said first and second open/close parts into said open position when in said closed position, to make said liquid reservoir open to the atmosphere.

2. The method according to claim 1, further comprising the step of:

e) pressurizing the liquid inside said liquid reservoir to said state of positive pressure again, while maintaining all of said open/close parts in said closed position, said step e) being performed after said step b), said step d) being performed after said step e).

3. The method according to claim 1, further comprising the step of:

f) maintaining said open position of each of said open/close parts when already in said open position, and bringing each of said open/close parts into said open position when in said closed position, to depressurize said liquid reservoir, thereby forming liquid menisci in said nozzles of said heads, said step f) being performed after said step c).

4. The method according to claim 3, wherein said step f) is performed after said step c) is performed so that the pressure of the liquid inside said liquid reservoir reaches atmospheric pressure.

5. A liquid ejecting apparatus for ejecting a liquid onto a recording medium to record an image thereon, comprising:

a head unit having a plurality of heads each including a plurality of nozzles for ejecting the liquid;

a liquid reservoir for temporarily storing the liquid for supply to said head unit;

a plurality of supply passages for supplying the liquid from said liquid reservoir therethrough to said respective heads;

a plurality of open/close parts provided in said respective supply passages, said open/close parts being switchable between an open position independently ensuring the communication between said liquid reservoir and said heads and a closed position independently closing off the communication between said liquid reservoir and said heads;

a pressurizing part for pressurizing the liquid inside said liquid reservoir;

a depressurizing part for depressurizing the liquid inside said liquid reservoir;

an open-to-atmosphere part for making the liquid inside said liquid reservoir open to the atmosphere; and a controller for controlling the switching of said open/close parts between said open position and said closed position, the pressurization of the liquid inside said liquid reservoir by means of said pressurizing part, the depressurization of the liquid inside said liquid reservoir by means of said depressurizing part, and the process of making the liquid inside said liquid reservoir open to the atmosphere by means of said open-to-atmosphere part, said controller performing the following operations:

a pre-pressurization operation for pressurizing the liquid inside said liquid reservoir to a state of positive pressure higher than atmospheric pressure by means of said pressurizing part while maintaining all of said open/close parts in said closed position;

a first purge operation for bringing a first one of said open/close parts into said open position and bringing all other ones of said open/close parts into said closed position after said pre-pressurization operation;

a second purge operation for bringing a second one of the open/close parts except said first open/close part brought into said open position by said first purge operation into said open position and bringing all other ones of said open/close parts into said closed position after said first purge operation;

an open-to-atmosphere operation for making said liquid reservoir open to the atmosphere by means of said open-to-atmosphere part after said first purge operation;

said first purge operation is an operation for bringing said first open/close part into said open position, and then bringing said first open/close part into said closed position after a predetermined time period has elapsed since said first open/close part was brought into said open position; and said open-to-atmosphere operation is an operation for maintaining said open position of said first and second open/close parts brought into said open position by said first and second purge operations when already in said open position, and bringing said first and second open/close arts into said open position when in said closed position to make said liquid reservoir open to the atmosphere, said open-to-atmosphere operation being performed after said second purge operation.

6. The liquid ejecting apparatus according to claim 5, wherein said controller further performs a re-pressurization operation for pressurizing the liquid inside said liquid reservoir to said state of positive pressure again by means of said pressurizing part, while maintaining all of said open/close parts in said closed position, said re-pressurization operation being performed after said first purge operation, and said controller performs said second purge operation after said re-pressurization operation.

7. The liquid ejecting apparatus according to claim 5, wherein said controller further performs a meniscus formation operation for maintaining said open position of each of said open/close parts when already in said open position, and bringing each of said open/close parts into said open position when in said closed position, to depressurize said liquid reservoir by means of said depressurizing part, thereby forming liquid menisci in said nozzles of said heads, said meniscus formation operation being performed after said open-to-atmosphere operation.

8. The liquid ejecting apparatus according to claim 7, wherein said controller performs said meniscus formation operation after performing said open-to-atmosphere operation so that the pressure of the liquid inside said liquid reservoir reaches atmospheric pressure.

* * * * *